US011156421B2

(12) United States Patent
Dunham

(10) Patent No.: US 11,156,421 B2
(45) Date of Patent: Oct. 26, 2021

(54) FIREARM AND METHODS FOR OPERATION AND MANUFACTURE THEREOF

(71) Applicant: DK Precision Outdoor, LLC, Portland, OR (US)

(72) Inventor: Michael Nathan Dunham, Central Point, OR (US)

(73) Assignee: DK Precision Outdoor, LLC, Portland, OR (US)

( * ) Notice: Subject to any disclaimer, the term of this patent is extended or adjusted under 35 U.S.C. 154(b) by 0 days.

(21) Appl. No.: 16/714,619

(22) Filed: Dec. 13, 2019

(65) Prior Publication Data

US 2020/0248979 A1 Aug. 6, 2020

Related U.S. Application Data

(60) Provisional application No. 62/780,120, filed on Dec. 14, 2018.

(51) Int. Cl.
*F41A 19/10* (2006.01)
*F41A 17/54* (2006.01)

(52) U.S. Cl.
CPC ..... *F41A 19/10* (2013.01); *F41A 17/54* (2013.01)

(58) Field of Classification Search
CPC ..... F41A 11/00; F41A 11/02; F41A 11/04; F41A 11/06; F41C 7/06
See application file for complete search history.

(56) References Cited

U.S. PATENT DOCUMENTS

| | | | | |
|---|---|---|---|---|
| 90,614 | A | 5/1869 | Von Martini | |
| 132,222 | A | 10/1872 | Von Martini | |
| 1,338,381 | A * | 4/1920 | Lewis | F41A 15/06 42/46 |
| 2,453,683 | A | 11/1948 | Caldow | |
| 2,606,384 | A | 8/1952 | Perry | |
| 2,967,368 | A | 1/1961 | Williams | |
| 3,153,874 | A * | 10/1964 | Merrill | F41A 3/58 42/41 |
| 3,377,731 | A * | 4/1968 | Lawrence | F41C 7/06 42/20 |
| 4,040,196 | A * | 8/1977 | Smith | F41A 3/10 42/23 |
| 4,121,364 | A | 10/1978 | Kaltenegger | |
| 4,452,001 | A * | 6/1984 | Compton | F41A 3/10 42/23 |
| 4,864,761 | A | 9/1989 | Gregory | |
| 5,320,023 | A * | 6/1994 | Erdem | F41A 3/66 42/7 |
| 6,189,253 | B1 | 2/2001 | Knight et al. | |
| 9,377,260 | B2 | 6/2016 | Locher et al. | |
| 9,618,289 | B1 | 4/2017 | Geissele | |
| 10,077,960 | B2 | 9/2018 | Geissele | |
| 2011/0162248 | A1* | 7/2011 | Trpcic | F41A 17/56 42/108 |
| 2014/0352187 | A1* | 12/2014 | Bubits | F41A 3/00 42/2 |

(Continued)

*Primary Examiner* — Bret Hayes
(74) *Attorney, Agent, or Firm* — McCoy Russell LLP

(57) ABSTRACT

Methods and systems are provided for a firearm. The firearm may also include features facilitating efficient assembly/disassembly of the action such as a disassembly latch facilitating rapid and efficient removal of the firearm's action assembly and well as efficient action manufacturing methods.

18 Claims, 20 Drawing Sheets

(56) References Cited

U.S. PATENT DOCUMENTS

2015/0247688 A1* 9/2015 Zonshine ..... F41A 3/58
42/8
2015/0300772 A1* 10/2015 Carson ..... F41A 21/06
42/17

* cited by examiner

FIREARM AND METHODS FOR OPERATION AND MANUFACTURE THEREOF

CROSS REFERENCE TO RELATED APPLICATION

This application claims priority to U.S. Provisional Application No. 62/780,120, entitled "FIREARM AND METHODS FOR OPERATION AND MANUFACTURE THEREOF," filed Dec. 14, 2018, the entire contents of which is hereby incorporated by reference in its entirety for all purposes.

FIELD

The present description relates generally to a firearm and methods for manufacture and operation of a firearm.

BACKGROUND AND SUMMARY

Civilian gun owners use firearms for a variety of purposes such as self-defense, hunting, target shooting, competitions, collecting, etc. Breech loading rifles are popular amongst many gun owners due to their quick and reliable cartridge loading action. One such breech-loading rifle that has gained in popularity in recent years is the Martini-Henry rifle. The Martini-Henry rifle is highly sought after and collectable and is likely to continue increasing in popularity. Martini-Henry rifles have in the past, required multiple pins to be knocked out of the action body to breakdown the action. Knocking the pins out requires the use of special tools such as a hammer and punch due to the pin's interference fit, increasing disassembly time and effort. Furthermore, each pin retains a separate component in the action, requiring each component to be precisely aligned during reassembly, resulting in a tedious and laborious reassembly process.

Previous Martini-Henry rifles also include a threaded striker stop and screw for retaining the striker assembly in a desired position. Specifically, the classic Martini-Henry rifle has a stop nut retaining the striker and striker spring in the block. This stop nut threads into the block along with a stop nut locking screw, working against the stop nut and preventing the stop nut from unthreading. To remove the striker and striker spring in the classic Martini-Henry rifle design, two screwdrivers of different sizes are required. It is therefore time consuming to remove the striker, due to the specific tools needed to remove the threaded striker stop and screw, further exacerbating assembly/disassembly difficulties.

Prior Martini-Henry rifles also require a complex action manufacturing process. In prior Martini-Henry rifles, a rounded post included in the action body allows parts of the action to be removed from the action body. However, it is difficult and costly to cast or machine the post into the action body, due to the complex geometric profile of the action body, thereby driving up manufacturing costs.

Additionally, prior Martini-Henry rifle blocks include a pivot pin enclosure mating with a pivot pin. The pivot pin allows the block to move into a loading configuration where a cartridge can be inserted into a rear of the barrel and cocked configuration where a striker pin in the block is aligned with a cartridge in the barrel. However, the pivot pin serves as the sole interface between the action body and the breech. Therefore, the load path resulting from a cartridge discharge travels directly through the pivot pin and then to the action body in such a configuration. The pivot pin may have, at the time when the Martini-Henry rifle was originally designed, been strong enough to receive loads generated by black powder. However, modern smokeless power generates much more force than black powder. As such, Martini-Henry rifles using smokeless powder cartridges may damage the block pivot pin due to the localized load distribution on the pin.

Furthermore, the classic Martini-Henry rifle's lever typically has a catch hook on the butt end of the lever that is captured by an accommodating steel lever catch block mounted in the butt stock. The lever in this classic design has sharp edges on the butt end of the lever that can scrape or scratch a user's hand. The classic design also makes an undesirable noise when the lever is brought into the closed position and as it engages the lever catch block. The catch hook also presents more manufacturing difficulties.

Martini-Henry rifles and other breech loading rifles have also suffered from inaccuracy problems caused by thermal expansion of the barrel. For example, when repeated firearm discharge produces thermal expansion of the barrel, the dimensions of the barrel grow to a point where the barrel impinges against the forearm. When this occurs, the barrel can be forced in the opposite direction of the impingement, causing the impact point of the projectile to move from its zeroed point. The variance of pressure against the forearm can also alter the inherent harmonic vibration of the barrel also causing accuracy issues. Another source of accuracy issues can arise when a forearm is rigidly affixed to both the barrel and the action. When the forearm is attached in this manner, the variation in thermal expansion of the barrel and forearm can work against the action and put undesirable force on the barrel.

The inventors herein have recognized the issues described above and designed a firearm with assembly/disassembly features and methods for firearm manufacturing to at least partially overcome the aforementioned issues. The assembly/disassembly features facilitate fast and efficient assembly and disassembly of the firearm. For example, the firearm described herein may be broken down in a less than a minute when compared to 5-10 minutes for previous Martini-Henry rifles. Additionally, the manufacturing methods increase manufacturing efficiency to drive down manufacturing costs.

In another example, the firearm may include a disassembly latch allowing for efficient removal of the action assembly from the action body. The disassembly latch is positioned at a front side of the action assembly and includes a protrusion mating with a recess in the action body when the disassembly latch is in a latched configuration. In an unlatched configuration, the protrusion in the disassembly latch is spaced away from the recess. In this way, a user is able to efficiently disconnect the action assembly from the action body. Consequently, the firearm may be more quickly assembled and disassembled when compared to previous rifles requiring multiple pins to be knocked out of the action during breakdown. In one example, the disassembly latch may only be actuated when an extractor in the action assembly is in an extraction position. In this way, the likelihood of unwanted disassembly latch actuation is reduced.

The firearm may also include, in one example, a trigger guard support pin separately manufactured from the action assembly and then subsequently press fit into the action body. In this way, manufacturing efficiency of the action body is increased when compared to previous action body designs requiring a post to be cast or machined into the action body.

In yet another example, the firearm may include a removable block support laterally positioned between two walls of the trigger guard. The removable block support is designed to receive firing forces from the block and transfer said forces to the back of the action body. In this way, the removable block support allows forces to be transferred to a stronger area of the action and relieves unnecessary loading on the block pivot pin. As a result, firing forces may be dispersed through a controlled path to alleviate stresses on weaker components. Therefore, the likelihood pivot pin damage, caused by repeated loading, is considerably reduced. The removable block support may be replaced if damaged by an over pressure situation, and may prevent the need to replace the firearm action. The removable block support may also increase manufacturing efficiency by eliminating the step of machining the detail into the inside back of the action.

The firearm may also include a removable striker stop pin securing the striker assembly in a desired position. The removable striker stop pin allows the striker assembly to be more efficiently assembled/disassembled when compared to previous striker assembly designs including a threaded stop pin and screw requiring tools to insert and remove the threaded pin. The removable striker stop pin also increasing manufacturing efficiency by eliminating the need to machine threads into the block and striker stop, if desired.

In another example, the firearm may include a spring loaded catch plunger in the removable block support designed to dampen or in some cases eliminate the impact between the lever and a stock during lever actuation. In this way, unwanted noise and vibration occurring during firearm reloading is reduced and in some cases eliminated.

The firearm may also include a gap between the action body and the forearm to accommodate thermal expansion of the barrel during use of the firearm, in one example. A forearm lug and mounting screw coupling the forearm to the barrel allow the gap to be formed between the barrel and the forearm, in one example. Additionally, the gap between the action body and the forearm may be created by a forearm bracket attached to a front side of the action body and a rear side of the forearm. In such an example, the forearm bracket may also be enclosed via a compliant material (e.g., rubber). The compliant material reduces the change of damage to forearm caused by external forces and provides acoustic dampening during firearm discharge.

It should be understood that the summary above is provided to introduce in simplified form, a selection of concepts that are further described in the detailed description. It is not meant to identify key or essential features of the subject matter. Furthermore, the disclosed subject matter is not limited to implementations that solve any disadvantages noted above or in any part of this disclosure.

BRIEF DESCRIPTION OF THE DRAWINGS

FIGS. 1-34 and 38-41 are shown approximately to scale. However, other relative dimensions may be used, in other examples.

DETAILED DESCRIPTION

Figure 1:
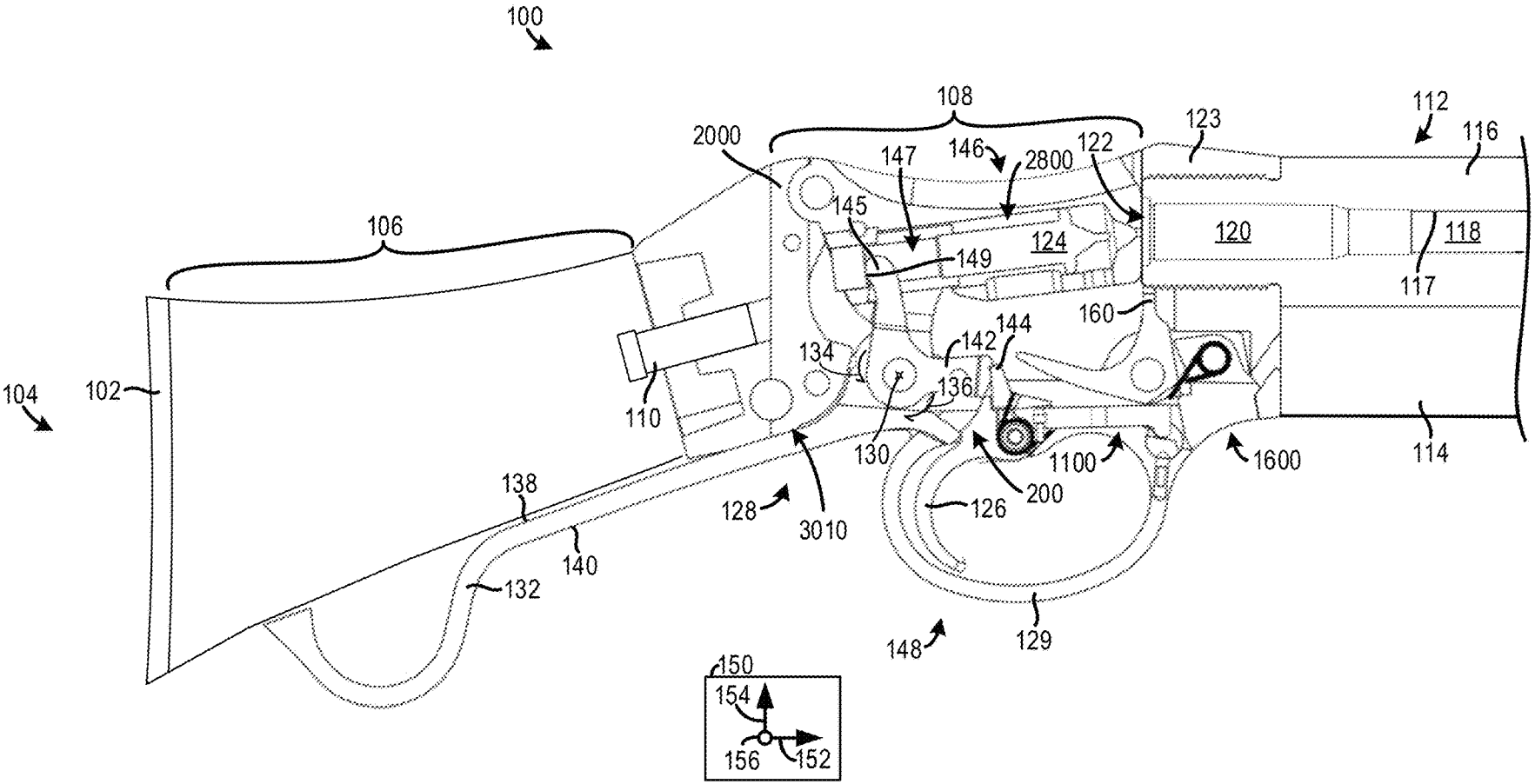
FIG. 1 shows an illustration of a firearm.

The following description relates to a firearm, such as a breech loading firearm (e.g., Martini-Henry style rifle). The firearm may be designed with several safety features decreasing the likelihood of unwanted firearm discharge as well as features for efficient assembly/disassembly of the action and other firearm components. The firearm may also be designed with features allowing for quick and efficient assembly/disassembly of the action. Additionally, the firearm may have several design features enabling simplified and efficient manufacturing of the action body and action. The firearm may also have several design features mitigating barrel and action body misalignment caused by thermal expansion of the barrel. The firearm may also include a dampening mechanism for reducing (e.g., eliminating) impacts between the lever and stock during lever cocking.

In one example, the firearm safety features may include a trigger block with a flange on a rear side of the trigger. The trigger block prevents the trigger from being actuated when a lever in the action is in a partially cocked position. In this way, the firearm may only be fired when the lever is in a desired position. As a result, firearm safety is increased.

The safety features may also include a safety mechanism positioned in front of the trigger in a trigger guard. The safety lever includes a safety lever pivoting about a fulcrum and an angled face selectively inhibiting trigger movement. As such, the safety lever, in a first position, blocks the trigger from being actuated and, in a second position, allows the trigger to be actuated. In this way, firearm safety is further increased by allowing a user to selectively deactivate the trigger. Furthermore, by positioning the safety mechanism in front of the trigger and integrating the mechanism into the trigger guard the mechanism can be efficiently actuated, increasing operational efficiency of the firearm.

In one example, the action assembly may include a disassembly latch. When actuated, the disassembly latch allows the action assembly to be efficiently removed from the action body. The disassembly latch may be positioned at a front side of the action assembly. A latching protrusion in the latching assembly engages and disengages with a latching face in the action body. When the latching assembly is disengaged the action assembly pivots about a trigger guard support pin at a rear side of the action assembly. In one example, the action assembly may be removed in one-piece, further increasing assembly/disassembly efficiency.

In another example, the action body may include a trigger guard support pin press fit into an opening in the action assembly. The trigger guard support pin allows the action assembly to be smoothly removed from the action body. Separately manufacturing the trigger guard support pin and pressing the pin into an opening in the action body simplifies action body manufacturing when compared to an action body cast or machined as a single component with a curved post.

In another example, the action body may include a removable block support laterally positioned between sections of a trigger guard. The removable block support is designed to receive firing loads from the block and transfer the loads to the action body. In this way, the removable block support allows forces to be transferred to a stronger area of the action, relieving unnecessary loading on the block pivot pin. As a result, firing forces may be dispersed through a controlled path to reduce the likelihood of block pivot pin damage caused by localized pin loading. Pins may be used to attach the removable block support to the trigger guard, in one example. It will be appreciated that the removable block support may be separately manufactured from the trigger guard. Consequently, manufacturing of the action assembly may be simplified, thereby decreasing manufacturing costs.

In yet another example, the block may include a removable striker stop pin extending laterally through a striker stop to retain the striker stop in a desired position in the block. Providing a removable striker stop pin in the action assembly allows for efficient disassembly of the striker subassembly when compared to previous techniques utilizing screws and nuts to retain the striker stop in a desired position.

In another example, the action assembly may include a spring loaded catch plunger in the block support designed to dampen and, in some instances, prevent the lever from directly contacting the stock when the lever is in a cocked position. In this way, unwanted noise and vibration caused by the lever slamming into the stock during lever actuation can be reduced (e.g., eliminated).

In another example, the firearm may be designed with gaps between the barrel and forearm and/or the forearm and the action body. The gaps accommodate thermal expansion of the barrel, to reduce movement between the forearm and barrel, thereby decreasing firing inaccuracies. In such an example, a forearm screw may be used to attach the barrel to the forearm and a forearm bracket may be used to attach the forearm to the action body to create the gaps. In one instance, a compliant bushing (e.g., rubber bushing) may be used to attached the forearm to the action body to reduce the likelihood of damage to the forearm, caused by external forces and provide acoustic dampening during firearm discharge.

Turning now to FIG. 1, a first embodiment of a firearm 100 is depicted. The firearm 100 illustrated in FIG. 1 is a breech loading firearm and specifically a Martini-Henry style rifle with a variety of updated features. It will be understood that a Martini-Henry style rifle is a breech-loading single-shot lever actuated rifle. The features of the firearm, however, are applicable to other firearm styles and therefore are not limited to only Martini-Henry style rifles, but may be used in a variety of firearms including but not limited to bolt action firearms, semi-automatic firearms, automatic firearms, handguns, shotguns, etc. Furthermore it will be understood that a breech loading rifle is a rifle designed with a loading mechanism enabling a cartridge or shell to be loaded into a chamber adjacent to rear end of a barrel.

An axis system 150 including three axes: axis 152 (e.g., longitudinal axis), axis 154 (e.g., vertical axis), and axis 156 (e.g., lateral axis), is provided in FIGS. 1-15 for reference. The vertical axis may be parallel to a gravitational axis, in one example. Moreover, the axes are perpendicular to one another. However, the axes may have other orientations, in other examples.

As shown in FIG. 1, the firearm 100 includes a butt 102 at the rear side 104 of the firearm. The butt 102 is attached to a stock 106. The butt 102 and stock 106 function to secure the firearm 100 on a user's shoulder. However, other firearm designs have been contemplated such as handheld firearms, rifles without stocks, etc.

The stock 106 is connected to an action assembly 108 via a bolt 110. However other suitable attachment mechanisms have been envisioned including but not limited to welds, press fit pins, adhesive, clamps, pins and slots, combinations thereof, etc.

The firearm 100 further includes a barrel 112 and a forearm 114 coupled to the barrel. The barrel 112 includes a housing 116 whose interior surface 117 defines a boundary of a bore 118. A user may grip the forearm 114 during use of the firearm. The forearm 114 and the stock 106 may be discrete sections spaced away from one another, in one example. While in other examples, the forearm 114 and the stock 106 may be formed from a continuous piece of material.

The barrel 112 is designed to guide a projectile (e.g., bullet, shot, slug, etc.) in a desired direction. It will be appreciated that the projectile may be packaged in a cartridge including propellant (e.g., gunpowder), an ignition device (e.g., primer), and a case. When the firearm 100 is loaded, the cartridge resides in a chamber 120 of the barrel's bore 118. As such, the cartridge may be inserted into a rear end 122 of the barrel 112, during cartridge loading. When fired, the projectile exits the barrel 112 at a muzzle (i.e., the front end of the barrel). It will be appreciated that accessories such as a sight, optical scope, laser sight, silencer, etc., may be coupled to the barrel 112.

The barrel 112 is shown attached to an action body 123 that may be included in the action assembly 108. Specifically, the barrel 112 is shown threaded into the action body 123. However, additional or alternative attachment techniques may be used to couple the barrel 112 to the action body 123, such as pins, welds, press fitting, combinations thereof, etc.

The action assembly 108 of the firearm 100 is designed to load, lock, fire, extract and/or eject a cartridge from the chamber 120. The action assembly 108, in the illustrated example, is a breech loading single shot type assembly. That is to say that the firearm is designed to have a single cartridge loaded into the rear of the barrel and is also designed to release a striker 124 each time a trigger 126 is pulled and fire the single cartridge loaded in the barrel 112. However, the features of the firearm 100 described herein may be applicable to other types of actions such as single actions (e.g., rolling block actions, hinged block actions, etc.), break actions, bolt actions, repeating actions (e.g., repeating bolt actions, revolving actions, pump actions, lever actions, lever release actions, etc.,) autoloading actions (e.g., blockback actions, recoil actions, gas actions, etc.), etc. A trigger guard 129, is also shown in FIG. 1, and is configured to reduce the likelihood of unintended trigger actuation. As such, the trigger guard 129 at least partially longitudinally encloses the trigger 126.

A lever 128 in the action assembly 108 allows the firearm 100 to be placed in a cocked configuration and a loading configuration. Thus, the lever 128 may be rotated about axis 130 to place the lever 128 in the loading position and the cocked position as well as positions there between. The positions there between may be referred to as partially cocked positions. Specifically, to place the lever 128 in the loading position the handle is moved away from the stock 106 in a first rotational direction 134. On the other hand, to place the lever 128 in the cocked position a handle 132 of the lever 128 is moved toward the stock 106 in a second rotational direction 136 opposing the first rotational direction 134. The handle 132 includes an upper surface 138 facing the stock 106 as well as a lower surface 140 facing away from the stock 106. Furthermore, the handle 132 may be curved or otherwise contoured to facilitate ergonomic actuation of the lever 128.

During loading of the firearm 100, the lever 128 is moved from the cocked position to the loading position. Cocking the lever 128 places the action assembly 108 in a cocked configuration where actuation of the trigger 126 will cause the firearm 100 to discharge a projectile.

In the firearm's cocked configuration, shown in FIG. 1, a tumbler 142 is engaged with a sear 144. Therefore, in the cocked configuration actuation of the trigger 126 releases the tumbler 142 which in turn actuates the striker 124 in a block 146 to ignite a primer in a cartridge and fire a projectile through the barrel 112. It will be appreciated that the tumbler 142 and the sear 144 may be included in the action assembly 108. Additionally, the tumbler 142 includes an upper extension 145 mating with an opening 147 in the striker 124. Specifically in the illustrated example, the striker 124 is in a cocked position and pre-loaded to strike a cartridge in the chamber 120. The upper extension 145 therefore presses against a rear side 149 of the opening 147 to retract the striker 124 into the cocked position.

Figure 38:
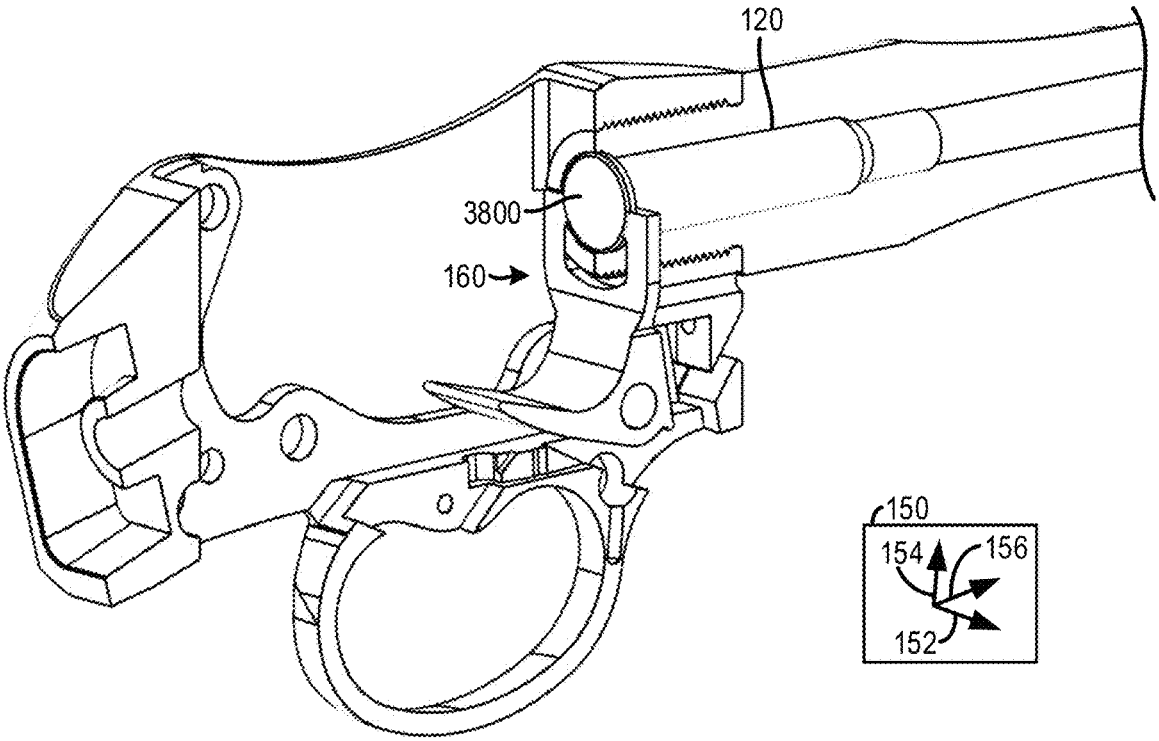
FIGS. 38-39 show an extractor in the action assembly of the firearm shown in FIG. 1, in a loading position and an extracted position, respectively.
Figure 39:
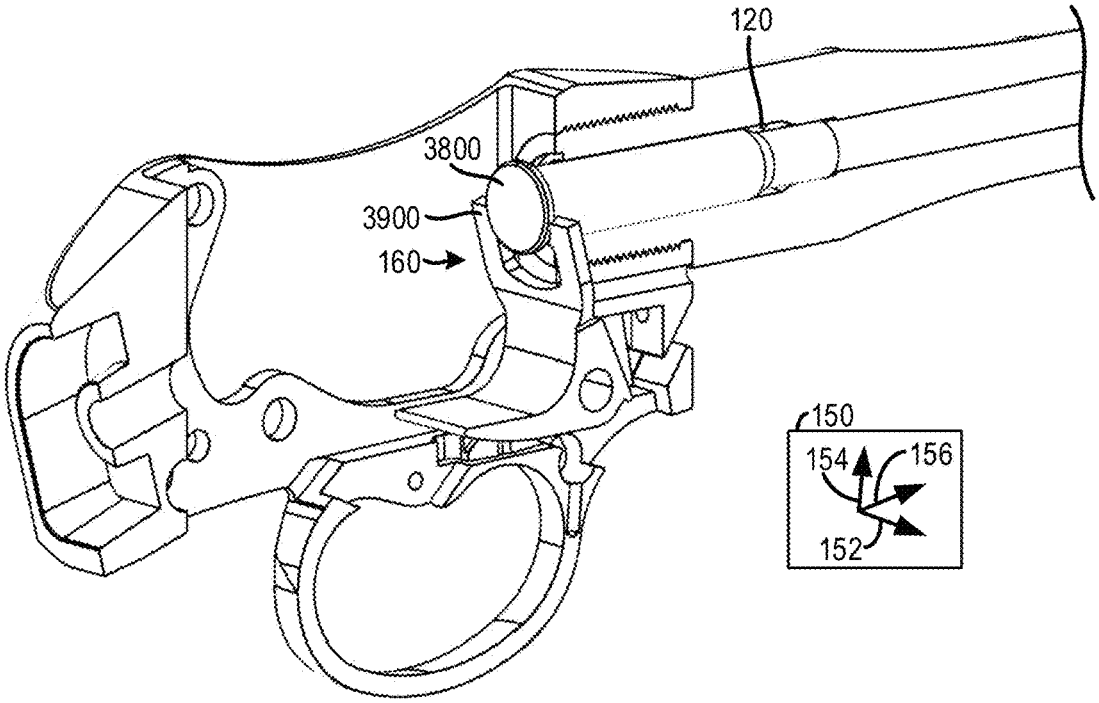

Additionally, the trigger 126 may be included in a trigger sub-assembly 148 of the action assembly 108 allowing the firearm 100 to be actuated. On the other hand, in a loading configuration the block 146 in the action assembly 108 is moved downward to allow a cartridge to be inserted into a rear end of the barrel 112. Thus, in the loading configuration the striker 124 is not aligned with the barrel 112. The action body 123 also may include an extractor 160 allowing a spent cartridge to be ejected from the rear end of the barrel 112, in some examples. The extractor 160 functions to engage a flange of a cartridge case to remove the cartridge from the action body. When the block 146 is rotated to its fully counterclockwise position, the bottom face of the block contacts the extractor 160 causing the extractor to rotate counterclockwise. FIGS. 38-39 illustrate the functional movement of the extractor 160, described in greater detail herein.

The stock 106 may be constructed out of a wooden material (e.g., walnut, maple, myrtle, birch, oak, laminated wood, etc.), a polymeric material, combinations thereof, etc., in some examples. The action assembly 108 may be constructed out of a metal (e.g., steel, aluminum, etc.), a polymeric material, combinations thereof, etc., in some examples. For instance, certain components may be constructed out of metal while others may be constructed out of a polymer. Still further in other examples, the action assembly 108 may be constructed solely out of metal. Further in one example, the forearm 114 may be constructed out of a wooden material (e.g., walnut, maple, myrtle, birch, oak, laminated wood, etc.), a plastic material, combinations thereof, etc. The barrel 112 may be constructed out of a metal such as carbon steel or stainless steel, in some examples. Additionally, the action body 123 may be constructed out of a metal (e.g., steel, aluminum, etc.), in one example.

FIG. 1 shows the trigger block 200, described in greater detail herein with regard to FIGS. 2-7, a trigger safety mechanism 1100, described in greater detail herein with regard to FIGS. 11-15, and a disassembly latch 1600, described in greater detail herein with regard to FIGS. 16-20. FIG. 1 also shows a removable block support 2000, described in greater detail herein with regard to FIGS. 23-27, a striker sub-assembly 2800, described in greater detail herein with regard to FIGS. 28-29, and a lever stop surface 3010, shown in FIGS. 30-31. It will be appreciated that, in one example, all of the aforementioned components are included in the action assembly 108. However, in other examples, one or more of the abovementioned components, features, etc., may be omitted from the action assembly 108.

FIGS. 2-7 show a trigger block 200 in the trigger 126 of the firearm 100. It will be appreciated that various components in the firearm 100 have been omitted to allow for viewing of the trigger block 200. The trigger block 200 prevents actuation of the trigger 126 when the lever 128 in the action assembly 108 is in a partially cocked position. Preventing trigger actuation when the lever 128 is partially cocked increases the safety of the firearm 100 by reducing the likelihood of unintended firearm discharge. FIGS. 2-7 show the tumbler 142, the lever 128 including the handle 132, sear 144, and trigger 126. The lever 128 acts to move the tumbler 142 into an engaged position with the sear 144. Additionally, the trigger 126 is configured to release engagement between the sear 144 and the tumbler 142.

The sear 144 and trigger 126 are designed to pivot about a common axis 202, in the illustrated example. However, in other examples, the sear 144 and the trigger 126 may not pivot about a common axis. Furthermore, the sear 144 is designed to rotate in a clockwise direction by a desired amount (e.g., 5 degrees) independent of rotation of the trigger 126, in the illustrated example. The independent rotation allows the trigger block feature to be achieved due to the sear and trigger actuation kinematics. Specifically, the tumbler 142 is allowed to engage with the sear 144 when the sear is independently rotated in a clockwise direction with regard to the trigger 126. However, it will be appreciated that rotation of the trigger 126 in a counterclockwise direction causes counterclockwise rotation of the sear 144, when the lever 128 is in a cocked configuration.

The lever 128 and the tumbler 142 also pivot about the common axis 130. In this way, the compactness of the action assembly 108 may be increased when compared to rifles with levers and tumblers that separately pivot. However, in other examples, the lever 128 and the tumbler 142 may not pivot about a common axis. Additionally, it will be appreciated that rotation of the lever 128 from a cocked position to a loading position causes rotation of the tumbler 142. The lever 128 generates tumbler 142 rotation via a top surface of the lower extension 210 in the lever pushing up on the bottom surface of the tumbler, rotating the tumbler in a counterclockwise direction, shown in FIGS. 3-5.

Figure 2:
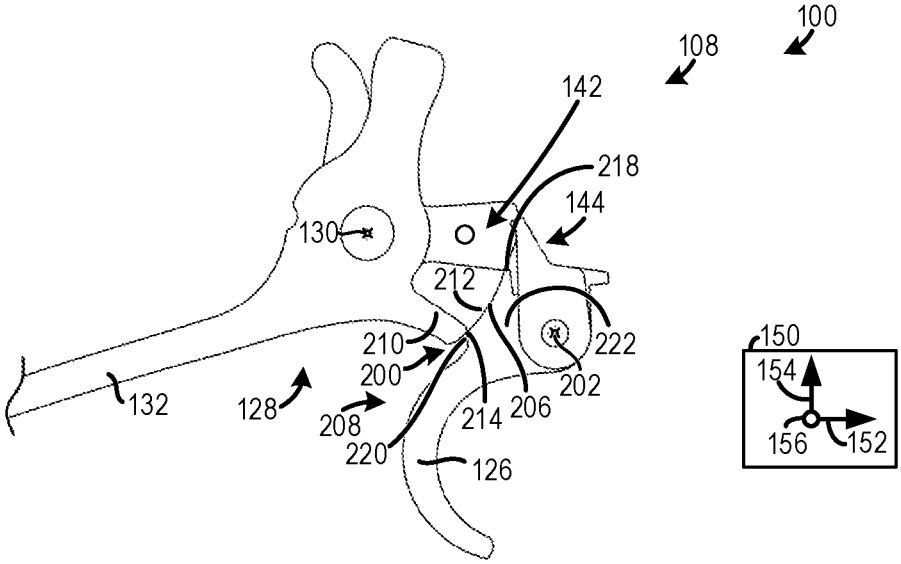
FIG. 2 shows a portion of the action assembly the firearm, shown in FIG. 1, including a trigger block.

FIG. 2 specifically shows the lever 128 in a partially cocked position between a fully cocked and a loading position. It will be appreciated that the lever may be placed in different positions between the fully cocked and loading position during lever actuation. In the loading position the lever 128 moves the block 146, shown in FIG. 1, downward such that a cartridge can be loaded into the firearm 100 through the block. In the fully cocked position the lever 128 moves the block 146, shown in FIG. 1, into a cocked position where the striker 124, shown in FIG. 1, is aligned with a cartridge. Thus, the cocking sequence involves moving the lever 128 counterclockwise into the loading position and then clockwise into the fully cocked position. As depicted in FIG. 2, the trigger block 200 includes a trigger-blocking flange 206 positioned on a rear side 208 of the trigger 126. The trigger-blocking flange 206 is in contact (e.g., face sharing contact) with a lower extension 210 in the lever 128, when the lever is in a partially cocked configuration. The trigger-blocking flange 206 includes a curved surface 212 interacting with a front surface 214 of the lower extension 210. It will be appreciated that the curved surface 212 and the front surface 214 may be correspondingly contoured to allow for smooth lever actuation.

The trigger-blocking flange 206 further includes a planar upper surface 218 and planar lower surface 220 with the curved surface 212 positioned there between. Additionally, the trigger-blocking flange 206 is recessed from a lateral surface 222 of the trigger 126. However, other contours of the trigger-blocking flange 206 have been contemplated. It will be appreciated that the trigger-blocking flange 206 inhibits trigger actuation across a range (e.g., a partial range near the lever's fully cocked position, a partial range near the lever's loading position, the full range, etc.) of partially cocked lever positions.

When the lever 128 and tumbler 142 are in cocked positions the trigger 126 can be pulled to initiate firearm discharge. On the other hand, when the tumbler 142 is in the cocked position and the lever 128 is in a partially cocked position the trigger is inhibited from being pulled via the trigger-blocking flange 206 in the trigger block 200. Furthermore, when the lever 128 is in the loading position a user can reload a cartridge for subsequent discharge.

The handle 132 in the lever 128 allows a user to actuate the lever. The handle 132 extends along a length of the stock 106, shown in FIG. 1, and is below the stock 106. However, other handle 132 profiles may be used, in other examples. For instance, the handle may retract into the stock or may extend further downward to allow the user to more easily grasp the lever.

FIGS. 3-7 show a cocking sequence in the action assembly 108 to place the tumbler 142 and the lever 128 in a cocked position. It will be appreciated that various components in the firearm 100 and specifically the action assembly 108 have been omitted to allow for viewing of the tumbler 142, lever 128, sear 144, and trigger 126. Additionally, the trigger guard 129 and a removable block support 2000 are shown in FIGS. 3-6. The trigger guard 129 longitudinally encloses the trigger 126, in the illustrated example. However, in other examples the trigger guard 129 may only partially surround the trigger 126 with regard to the longitudinal direction.

Figure 3:
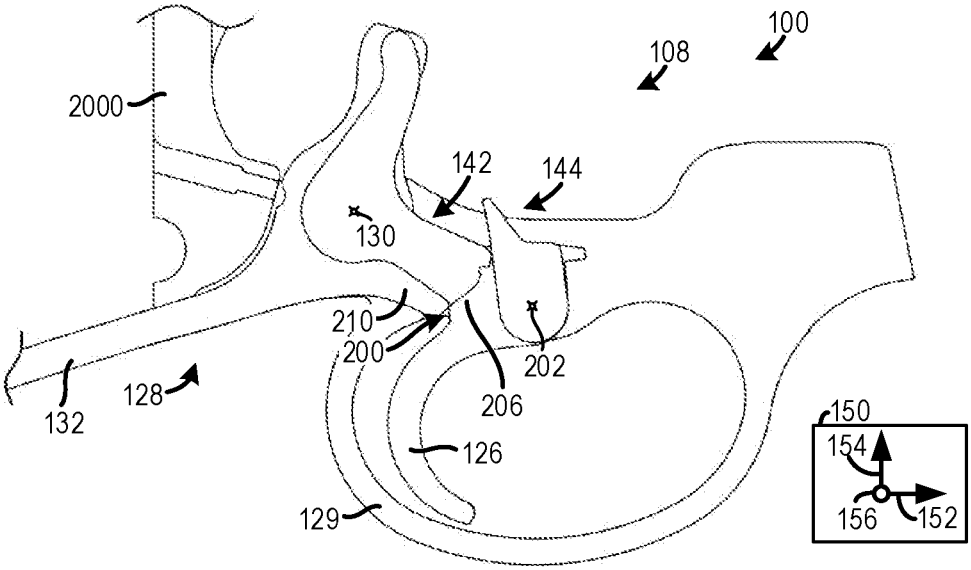
FIGS. 3-7 show a lever actuation sequence in the action assembly, shown in FIG. 2, where the trigger block prevents trigger actuation when the lever is in partially cocked positions.

FIG. 3 shows the lever 128 in a cocked position and the tumbler 142 in a disengaged position where it is not engaged with the sear 144. As such, the firearm 100 is in an inactive configuration and therefore is not prepared for discharge.

When the tumbler 142 is in a disengaged position, rotation (e.g., counterclockwise) of the lever 128 towards the loading position from the cocked position causes rotation (e.g., counterclockwise rotation) of the tumbler 142. Thus, the tumbler 142 and the lever 128 rotate in unison during an initial stage of cocking.

Figure 4:
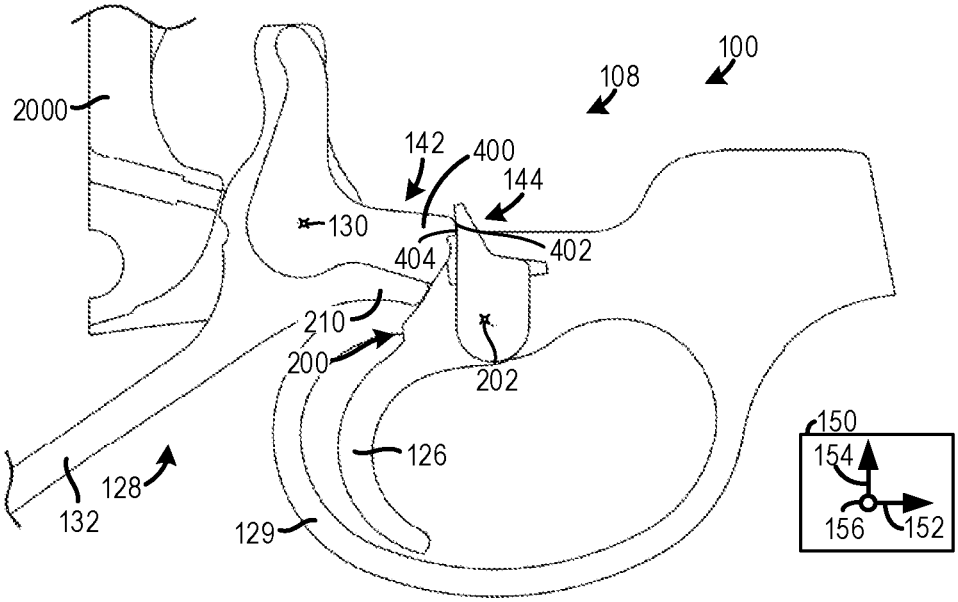

FIG. 4 shows further rotation of the lever 128 and the tumbler 142, in the cocking sequence. As such, the lower extension 210 in the lever 128 slides along the trigger-blocking flange 206. A lower extension 400 in the tumbler 142 is laterally offset from the trigger-blocking flange 206 to avoid interaction between the tumbler 142 and the trigger-blocking flange 206. In this way, the tumbler 142 may travel through its rotation adjacent to the sear 144 to allow the tumbler to interact with the sear. However, other tumbler contours have been envisioned.

FIG. 4 also shows a lower extension 400 in the tumbler 142 pushing the sear 144 forward such that is rotates in a clockwise direction. Specifically, a front face 402 of the tumbler 142 pushes on a rear surface 404 of the sear 144. As previously discussed, the sear 144 may be designed to rotate in the clockwise direction independent of trigger rotation by a predetermined amount (e.g., 5 degrees). In this way, the tumbler 142 is permitted to mate with the sear 144 without influencing trigger position.

Figure 5:
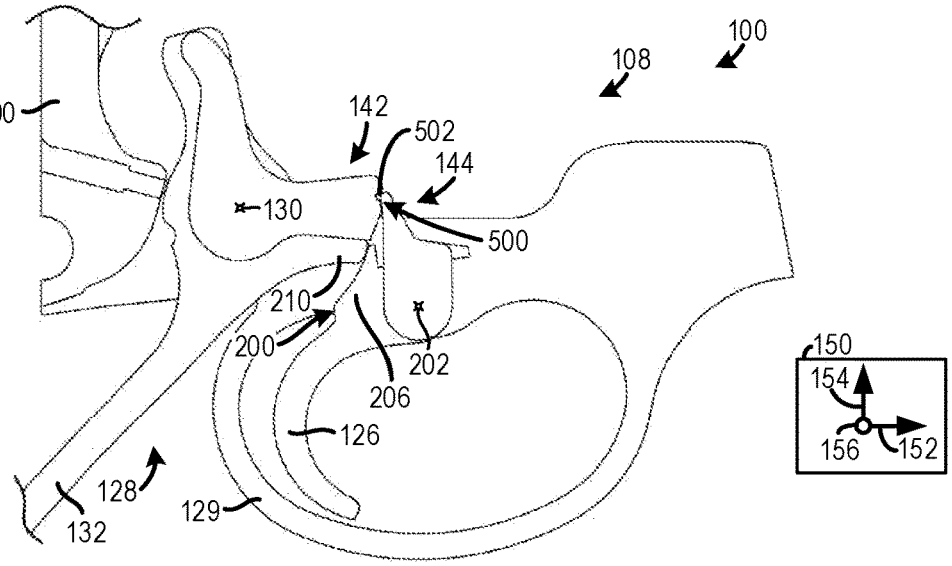

As shown in FIG. 5, when the lever 128 reaches the loading position the tumbler 142 engages with the sear 144, therefore bringing the tumbler into its cocked position. Specifically, a recess 500 in the tumbler 142 mates with a protrusion 502 (e.g., corner) of the sear 144. Thus, a portion of the tumbler 142 sits on top of the sear 144 preventing release of the tumbler 142. In this way, the tumbler 142 may be held in a cocked position by the sear 144. In the cocked position, the tumbler 142 is prepared to be released by the trigger 126. It will be appreciated that release of the tumbler 142 initiates a discharge event in the firearm 100. As shown in FIG. 5, the trigger-blocking flange 206 continues to interact with the lower extension 210 of lever 128. It will be appreciated that, in the depicted configuration, the trigger is only inhibited from rotating into the firing position when the lever is near its fully cocked position and the striker is aligning with the cartridge's primer as shown in FIG. 2 and FIG. 4. When the lever 128 continues to rotate in the counterclockwise direction to the point shown in FIG. 5 the trigger can rotate to the firing position. This design feature allows the trigger to be pulled when the lever is in the loading position. Therefore, the striker and striker spring can be unloaded while the lever is being rotated from the loading position back in the clockwise direction into the block closed position. Additionally, the trigger blocking flange 206 vertically extends on the back of the trigger to prevent the lower extension 210 from traveling over the flange 206, in the illustrated example. Furthermore, FIG. 5 depicts the lever 128 in the loading position that places the action body in a loading configuration for cartridge reload.

Figure 6:
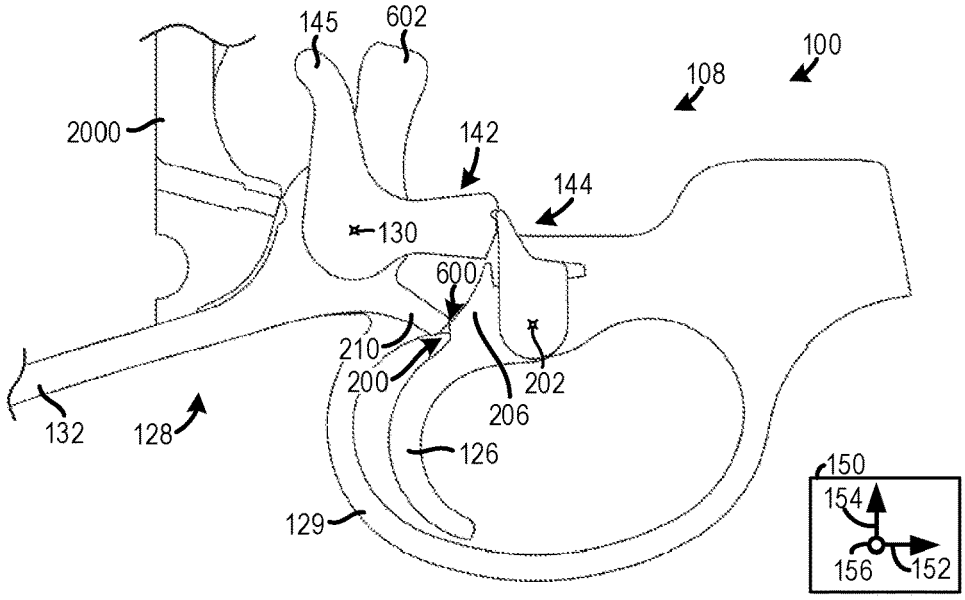

Subsequently, the lever 128 is rotated back into the cocked position, as shown in FIG. 6. FIG. 6 again shows the tumbler 142 engaged with the sear 144. It will be appreciated that in FIG. 6, the trigger-blocking flange 206 is not actively blocking the lower extension 210 in the lever 128. As such, a gap 600 exists between the trigger-blocking flange 206 and the lower extension 210 in the lever 128. Therefore, it will be appreciated that the trigger 126 is free to be actuated when the lever 128 is in the cocked position. In other words, when the lever 128 is in the attitude shown in FIG. 6 the trigger-blocking flange 206 is not impinging on the trigger 126, allowing the trigger to be pulled. It will be appreciated that the upper extension 145 in the tumbler 142 may be designed to interact with the striker 124, shown in FIG. 1, to preload the striker and place it in a cocked position. Specifically, the upper extension 145 mates with a recess in the striker and cocking of the tumbler retracts the striker to place it in the cocked position. In this way, the action assembly 108 is prepared for firearm discharge. However, other striker preloading kinematics have been contemplated.

Furthermore, the lever 128 includes an upper extension 602. It will be appreciated that when the lever travels through a cocking sequence the upper extension 602 interacts with the block 146, shown in FIG. 1, to place the block in a loading configuration and a firing configuration.

Furthermore, actuation of the trigger 126 causes the sear 144 to rotate, releasing the sear 144 from the tumbler 142. Releasing the tumbler 142 allows the tumbler to rotate clockwise and release the striker 124, shown in FIG. 1, causing the firearm to discharge a projectile.

Figure 7:
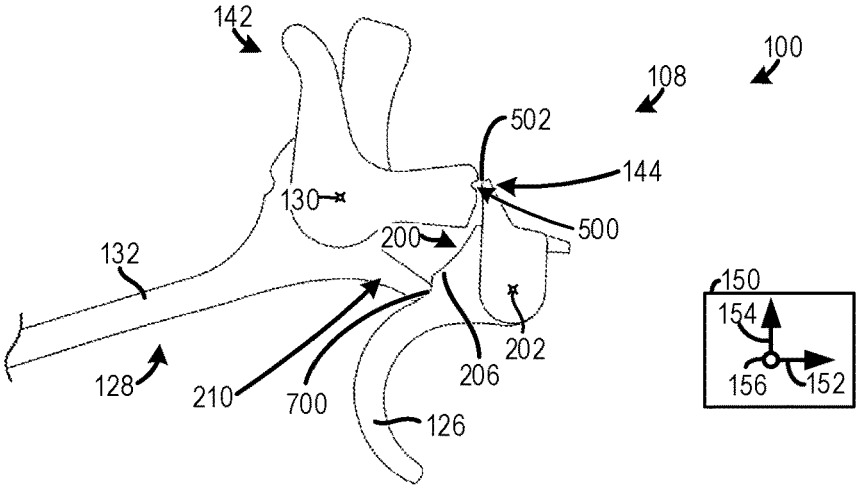

FIG. 7 shows action assembly 108 after the trigger 126 has been actuated and placed in a firing position. It will be appreciated that the trigger-blocking flange 206 in the trigger does not prevent trigger actuation when the lever 128 is in the cocked position. As shown, the lower extension 210 of the lever 128 is in contact with a section 700 of the trigger 126 below the trigger-blocking flange 206.

As shown, the sear 144 is rotated clockwise to move the protrusion 502 of the sear 144 away from the recess 500 in the tumbler 142. When the sear 144 is moved away from the tumbler 142, the tumbler 142 will subsequently rotate in a clockwise direction causing the striker 124, shown in FIG. 1, in the action assembly 108 to release and strike a cartridge in the barrel 112, shown in FIG. 1.

Figure 8:
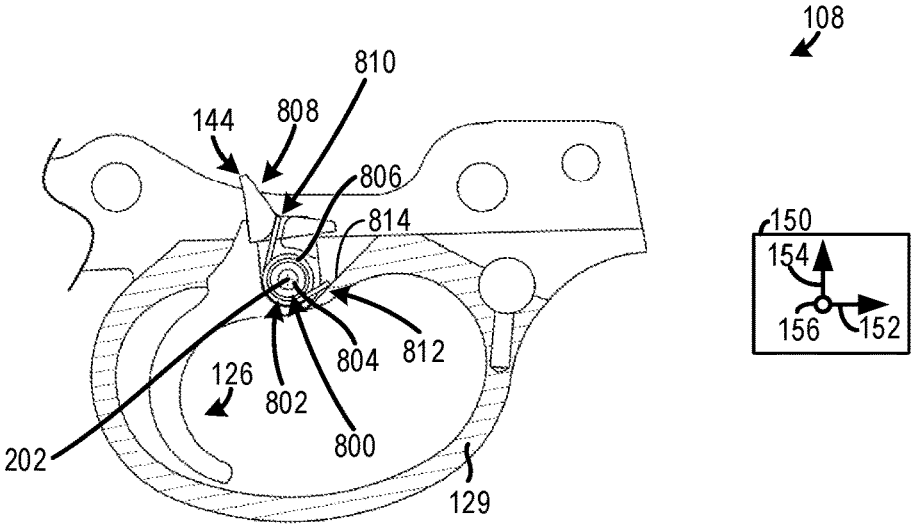
FIGS. 8-9 show different views of a sear and trigger included in the action assembly, shown in FIG. 1.
Figure 9:
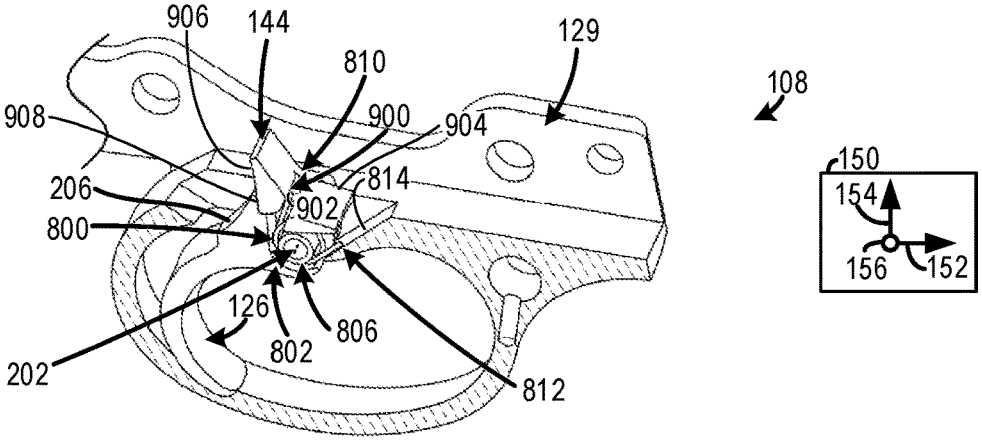

FIGS. 8 and 9 show another view of the action assembly 108. It will be appreciated that components in the action assembly 108 have been omitted to enable viewing of the interface between the sear 144 and the trigger 126.

As shown in FIG. 8, the trigger 126 and sear 144 rotate about the common axis 202. Additionally, the sear 144 may be rotated in a clockwise direction independent of the trigger 126. That is to say that the sear 144 may be rotated clockwise by a predetermined amount without conversely rotating the trigger 126. Specifically, in one example, the sear 144 may be rotated by 5 degrees before contacting the trigger 126, as previously discussed. In other examples, the free movement between the trigger and the sear may be between 0-15 degrees, 0-10 degrees, 0-8 degrees, etc. The free movement of the sear 144 accommodates the trigger-blocking feature by allowing the tumbler 142, shown in FIG. 6, to engage with the sear 144. The free movement of the sear 144 also facilitates operation of the trigger safety mechanism, described in greater detail herein with regard to FIGS. 11-15. FIG. 9 shows a gap 900 between the sear 144 and the trigger 126. The gap 900 allows for the free rotation of the sear 144.

As shown in FIGS. 8 and 9, the sear 144 includes a sear collar 800 extending through a sear recess 802 in the trigger 126. The sear collar 800 enables sear rotation about axis 202. Additionally, the sear collar 800 acts as a bearing surface for the trigger 126 to rotate upon. Additionally, it will be appreciated that a pin or a screw may extend through an interior opening 804 of the sear collar 800 to retain the sear 144 and the trigger 126 in a desired location, in some instances.

A sear spring 806 is shown attached to a front side 808 of the sear 144 and to the trigger guard 129. Specifically, FIGS. 8 and 9 depict the sear spring 806 wrapping around the sear collar 800 and including a first end 810 in contact with the front side 808 of the sear 144 and a second end 812 in contact with an interior surface 814 in the trigger guard 129. The interior surface 814 therefore acts as an impingement point for the sear spring 806. Moreover, the sear spring 806 preloads the sear 144 to allow the sear 144 to engage with the tumbler 142, shown in FIGS. 2-7, via an induced force. In this way, the sear 144 may be held against the tumbler 142, shown in FIGS. 2-7, until it is forced away from the tumbler. In turn, forcing the sear 144 away from the tumbler 142 causes release of the striker 124, shown in FIG. 1. Additionally, it will be appreciated that the sear spring 806 does not act on the trigger 126. However, the sear 144 may be spring loaded with other types of springs such as leaf springs, elastomeric materials, etc., in other examples.

FIG. 9 also shows a lateral wall 902 of the sear 144 interfacing with a lateral side 904 of the trigger 126, in the illustrated example. In this way, the sear 144 may be axially delimited by the trigger 126. However, other sear contours may be used, in other examples.

Additionally, a rear surface 906 of the sear 144 is in contact with an upper face 908 of the trigger 126 in front of the trigger-blocking flange 206. This interface between the sear 144 and the trigger 126 causes the trigger to actuate the sear when rotated in the clockwise direction. Additionally, the rear surface 906 and the upper face 908 have a planar profile. However, other contours of these surfaces have been envisioned.

Figure 10:
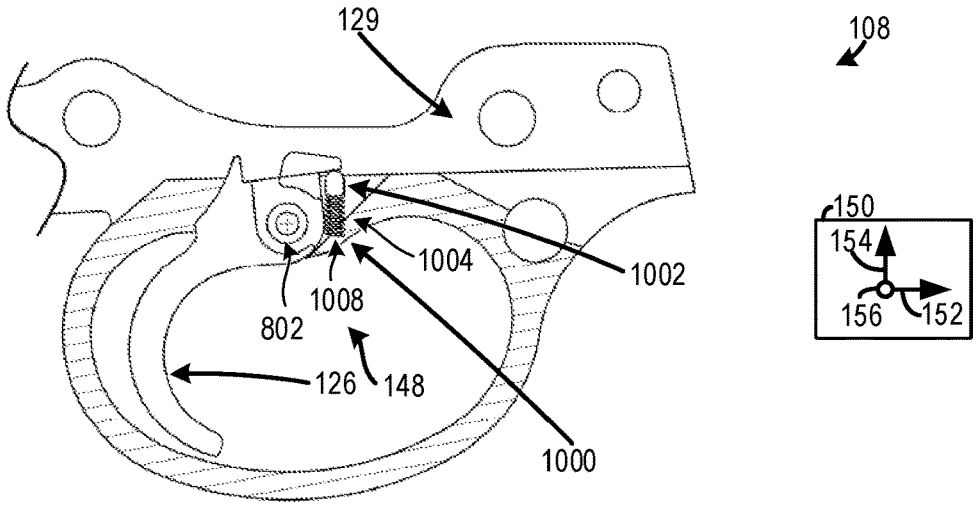
FIG. 10 shows a view of the trigger loaded via a coil spring in the action assembly, shown in FIG. 1.

FIG. 10 shows another view of the action assembly 108 with selected components omitted to enable viewing of the spring loading feature of the trigger 126. As shown, the trigger 126 is loaded via a coil spring 1000 and a trigger pin 1002. The coil spring 1000 and trigger pin 1002 function to urge the trigger back into a cocked position after the trigger is depressed and placed in a firing position. Specifically, in the illustrated example, the coil spring 1000 surrounds a lower section 1004 of the trigger pin 1002. However, at least a portion of the spring may not enclose the coil spring, in other examples. Spring loading the trigger 126 via the coil spring 1000 and trigger pin 1002 increases the compactness of the trigger mechanism when compared to previous triggers loaded with leaf springs. As a result, the compactness of the action assembly 108 is increased. As shown, the spring 1000 and trigger pin 1002 include a bottom end 1008 in contact with the trigger guard 129 to allow for spring compression. However, other spring retention features may be used, in other examples.

FIG. 10 also shows the trigger 126 including a sear recess 802 allowing the sear 144, shown in FIG. 9, to be positioned therein when the trigger sub-assembly 148 is assembled. In this way, the sear may be compactly arranged with regard to the trigger 126, thereby reducing the profile of the trigger sub-assembly, when compared to previous firearm designs having separate sears and triggers. However, triggers without sear recesses may be used, in other examples.

FIGS. 11-15 show the trigger safety mechanism 1100 designed to inhibit actuation of the trigger 126 when the mechanism is placed in a "safe" configuration. Conversely, when the trigger safety mechanism 1100 is placed in a "fire" configuration trigger actuation is permitted. It will be appreciated that the trigger safety mechanism 1100 is included in the action assembly 108. However, in other examples, the trigger safety mechanism 1100 may be omitted from the action assembly 108. The trigger safety mechanism 1100 overcomes a number of packaging challenges in the firearm. For instance, the difficulty with putting a safety button in the front of the trigger guard is the lack of available space in the area in front of the trigger. The extractor (when in the extracted position) shown in FIG. 18) may require almost all of the available area. Attempts to modify the extractor/block relationship were found to be complicated and unpractical. To create more room, a flat trigger spring, found in previous Martini-Henry rifles, was replaced with the spring loaded plunger 1406. Other difficulties getting a mechanism between the safety button and the trigger include a motion direction change between the safety button and the trigger. The illustrated trigger safety is formed as a single assembly. The safety lever 1112 toggles between the safety button and the front of the trigger creates the interface. To elaborate, the angled surfaces 1116 and 1118 create the space and lack thereof to allow the trigger to rotate or block the trigger from rotating. The safety lever 1112 is captured under the lever interface 1110 and the bottom surface of the extractor 160, shown in FIG. 1, and may require no other method of containment other than its nesting in the fulcrum opening 2404, shown in FIG. 24, if desired.

The trigger safety mechanism 1100 is positioned in front of the trigger 126, allowing the mechanism to be easily accessed. Consequently, the safety's operation efficiency may be increased. For instance, the trigger safety mechanism 1100 may be actuated by the forefinger of the user's shooting hand. However, safety mechanism layouts facilitating actuation of the mechanism by other fingers have been envisioned. As described herein, the front side of the firearm is a side of the firearm including the muzzle and the rear side of the firearm is a side of the firearm including a stock, butt, and/or handle.

Furthermore, the trigger safety mechanism 1100 may be at least partially integrated into the trigger guard 129, shown in FIG. 1. That is to say, a housing of the trigger guard 129 may at least partially enclose the trigger safety mechanism 1100. In this way, the compactness of the action assembly 108 may be further increased.

Figure 11:
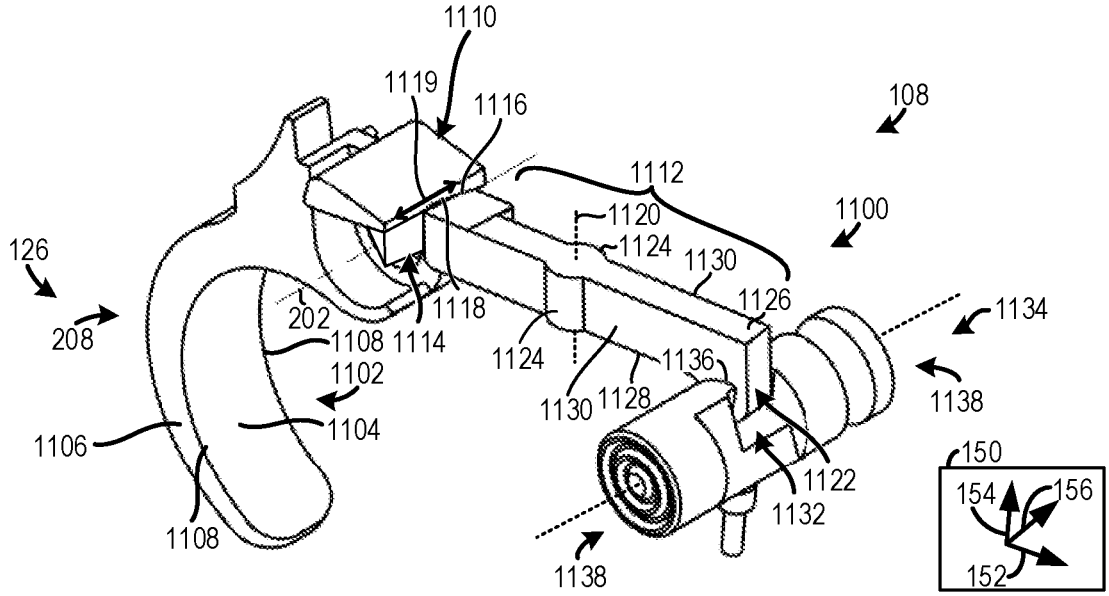
FIGS. 11-15 show different views of a safety mechanism.

FIG. 11 shows the trigger 126 pivoting about the pivot axis 202. The trigger 126 is shown including a front side 1102 and the rear side 208. The front side 1102 includes a curved surface 1104 allowing for ergonomic trigger actuation. Moreover, the rear side 208 of the trigger 126 includes a curved surface 1106. However, the trigger may include other curvatures, in other examples. The trigger 126 further includes lateral surfaces 1108. In the illustrated example, the lateral surfaces 1108 are planar. However, in other examples the lateral surfaces may curve inward or outward, or have other suitable contours.

The trigger 126 includes a lever interface 1110 interacting with the safety lever 1112 to allow for actuation of the trigger when the trigger safety mechanism 1100 is in the fire position. Conversely, the lever interface and safety lever interact to inhibit actuation of the trigger when the trigger safety mechanism is in the safe position. It will be appreciated that the safety mechanism 1100 is in the fire position in FIG. 11.

Figure 12:
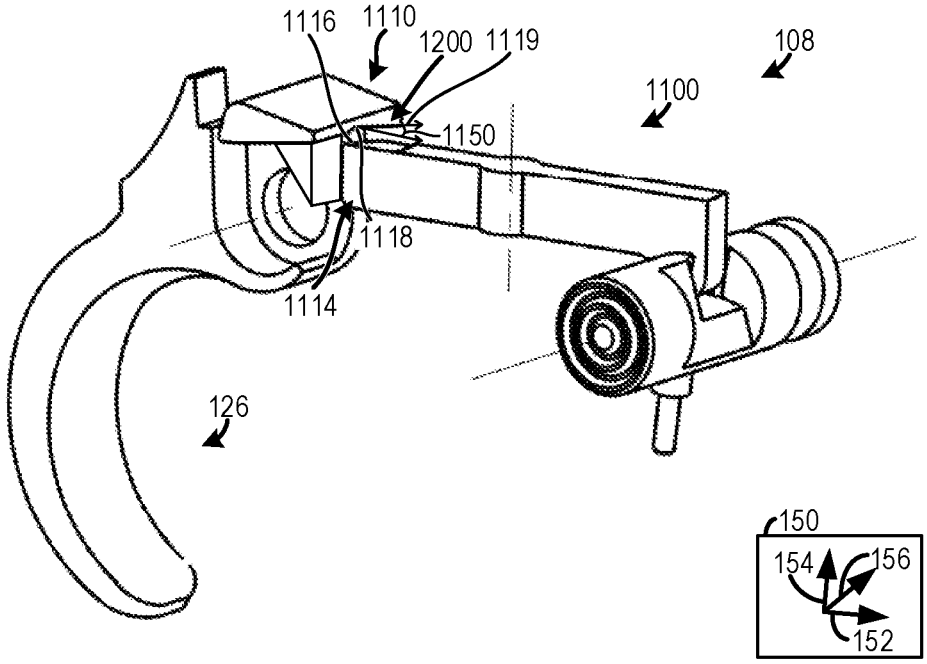
Figure 14:
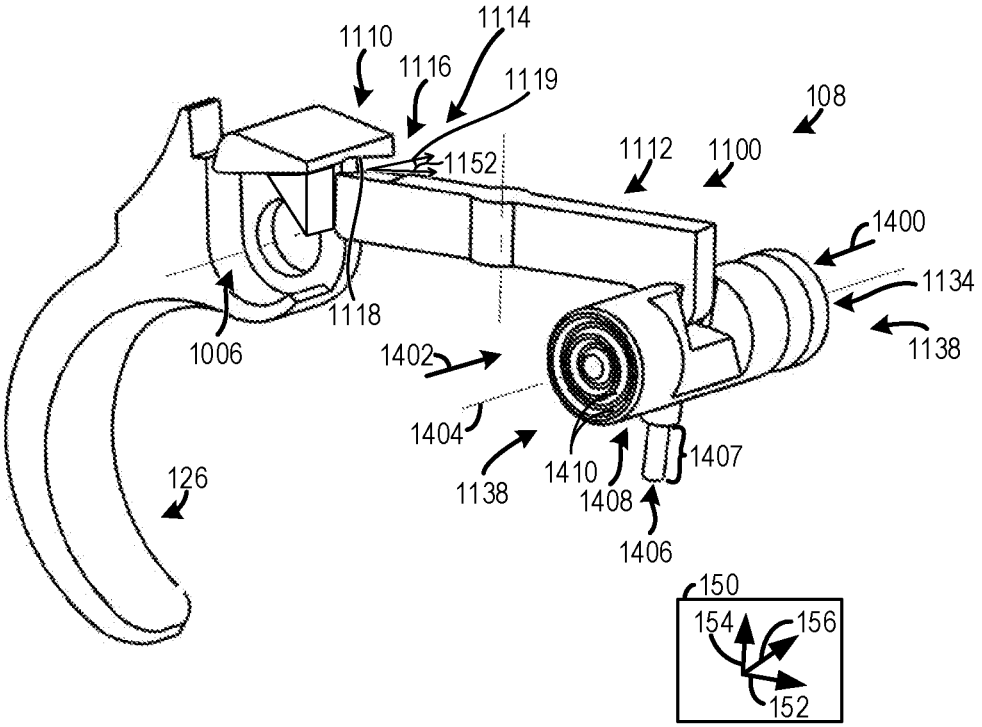

The safety lever 1112 includes a rear end 1114 having an angled surface 1116 interacting with an angled surface 1118 in the lever interface 1110 of the trigger 126 to facilitate the aforementioned safety functionality. Thus, in the safe position the angled surface 1116 is in contact with the angled surface 1118 shown in FIG. 11 and FIG. 14. However, in other examples there may be a small separation between the angled surfaces when the mechanism is in the safe configuration, in other examples. Additionally, the angled surface 1116 and the angled surface 1118 may have a substantially corresponding (e.g., identical) angle measured from a horizontal axis 1119, in some embodiments. For instance, the angled surface 1116 and/or the angled surface 1118 may be arranged at a 10 degree angle, 15 degree angle, 20 degree angle, between 10-30 degrees, etc. The angle 1150 of the angled surface 1118 is depicted in FIG. 12. The angle 1152 of the angled surface 1116 is depicted in FIG. 14.

Continuing with FIG. 11, the lever interface 1110 is also positioned in front of and above the trigger's axis of rotation 202, in the illustrated example. However, other lever interface 1110 positions are possible. Additionally, the lever interface 1110 tapers in a forward direction. However, other lever interface profiles have been contemplated.

The safety lever 1112 pivots about a fulcrum 1120. In the depicted example, the fulcrum 1120 is near the center of the lever. However, the fulcrum 1120 may be positioned closer to the rear end 1114 or a front end 1122 of the safety lever 1112, in other examples. Furthermore, the fulcrum 1120 may be parallel to the axis 154 (e.g., the vertical axis). However, other orientations of the fulcrum have been contemplated. The safety lever 1112 includes curved sections 1124 adjacent to the fulcrum 1120, in the illustrated example. The curvature of the safety lever 1112 allows the lever to be pivoted about the fulcrum 1120. It will be appreciated that the curved sections 1124 of the safety lever 1112 may mate with a fulcrum opening 2404 in the trigger guard 129, shown in FIG. 24, to facilitate rotation of the lever. However, in other examples, a pin extending through the fulcrum may allow for lever rotation.

The safety lever 1112 further includes a top surface 1126, a bottom surface 1128, and lateral side surfaces 1130. In the illustrated example, the aforementioned surfaces are planar. However, other surface contours have been contemplated.

A portion of the front end 1122 of the safety lever 1112 mates with a detent 1132 in a safety button 1134. To elaborate, the detent 1132 includes lateral faces 1136 interacting with lateral side surfaces 1130 of the safety lever 1112.

The safety button 1134 includes lateral sides 1138 allowing the button to be laterally slid into a "safe" position and a "fire" position which in turn places the safety lever in the safe position and the fire position, respectively. The safety button 1134 is in the fire position in FIG. 11. Thus, the trigger safety mechanism 1100 is in the fire configuration, in FIG. 11.

Figure 24:
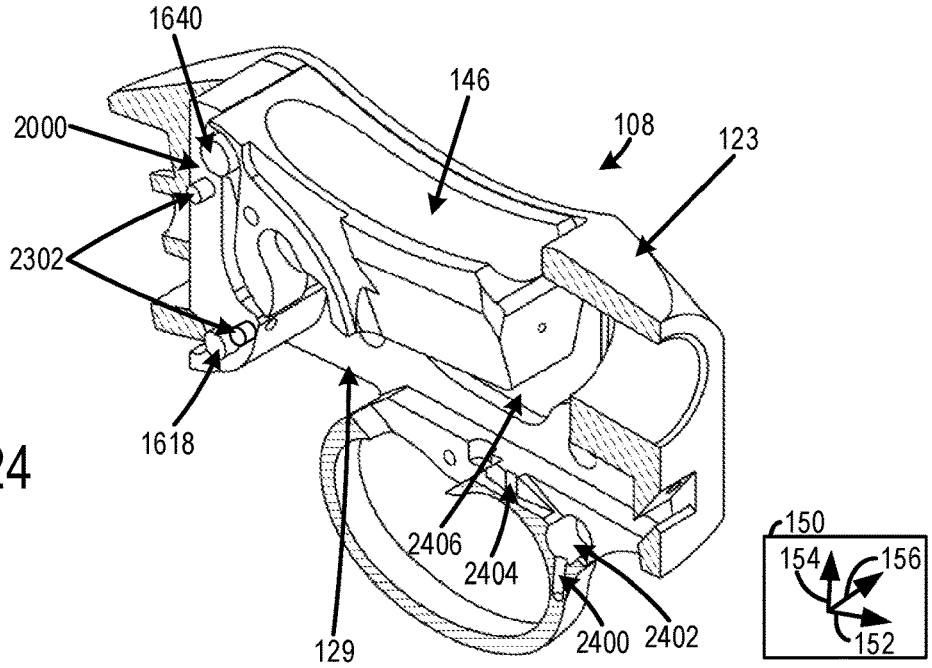

It will be appreciated that the safety button 1134 may extend through the safety button opening 2402 in the trigger guard 129, shown in FIG. 24, to allow the lateral sides 1138 of the button to be actuated. It will also be appreciated that the safety lever 1112 may be positioned in fulcrum opening 2404 in the trigger guard 129, shown in FIG. 24. In this way, the trigger safety mechanism 1100 may be compactly integrated into the trigger guard. As a result, a desired profile of the action assembly 108 can be achieved.

FIG. 12 shows another perspective view of the trigger safety mechanism 1100. In FIG. 12 the trigger safety mechanism 1100 is in the fire configuration allowing the trigger to be pulled. The angled surface 1118 in the lever interface 1110 in the trigger 126 is again illustrated. Likewise, the rear end 1114 of the safety lever 1112 including the angled surface 1116, is also illustrated. A gap 1200 exists between the angled surface 1116 of the safety lever 1112 and the angled surface 1118 of the lever interface 1110. The gap 1200 allows the trigger 126 to rotate to initiate firearm discharge in the action assembly 108. Thus, the gap 1200 accommodates rotation of the trigger to disengage the sear 144, shown in FIG. 1, from the tumbler 142, shown in FIG. 1.

Figure 13:
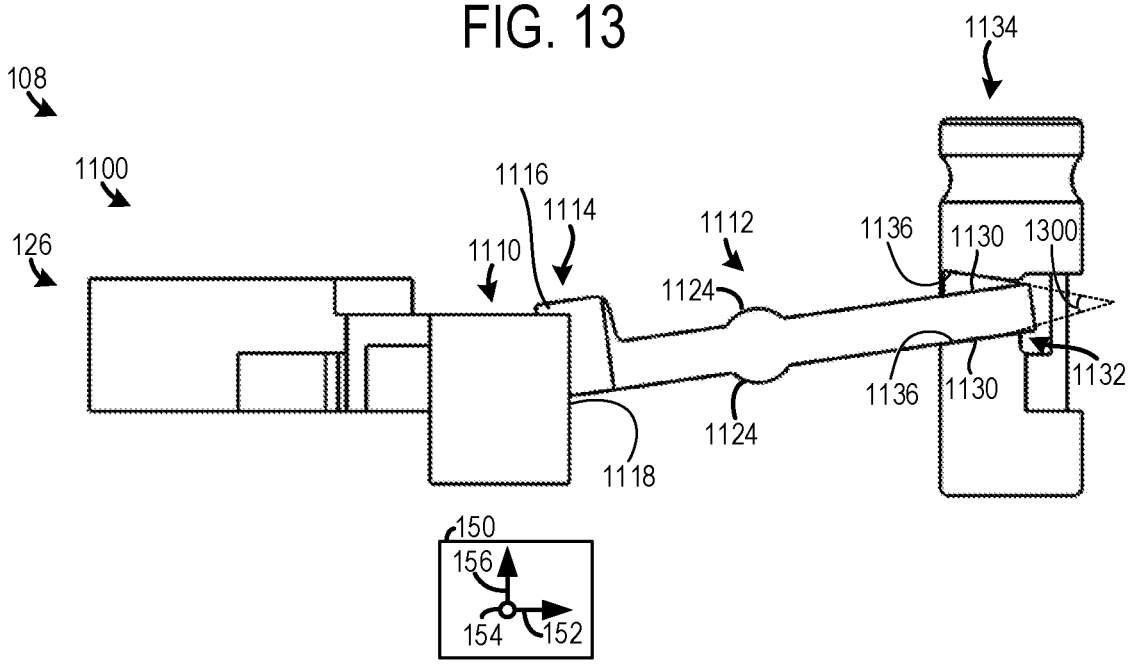

FIG. 13 shows a top view of the trigger safety mechanism 1100, shown in FIG. 11. Again, the trigger safety mechanism 1100 is in the fire configuration. In the fire configuration, one of the lateral faces 1136 in the detent 1132 of the safety button 1134 is in face sharing or near face sharing contact with one of the lateral side surfaces 1130 in the safety lever 1112. FIG. 13 again shows the trigger 126 including the lever interface 1110 with the angled surface 1118 spaced away from the angled surface in the rear end 1114 of the safety lever 1112.

Additionally, the lateral side surfaces 1130 in the safety lever 1112 are parallel to one another, in the example illustrated in FIG. 13. However, non-parallel lateral surfaces have been contemplated. Curved sections 1124 of the safety lever 1112 are also shown in FIG. 13.

Furthermore, the lateral faces 1136 of the detent 1132 in the safety button 1134 are arranged at an angle 1300 with regard to one another. The angle 1300 may be between 5 and 30 degrees, in one example. However, other suitable angles or angle ranges have been contemplated. In this way, the detent 1132 is shaped to accommodate rotational movement of the safety lever 1112.

FIG. 14 shows the trigger safety mechanism 1100 in the safe position. It will be appreciated that the safety button 1134 may be pushed in a direction 1400 to rotate the safety lever 1112 into the safe position. Conversely, pushing the safety button 1134 in a direction 1402, opposing the direction 1400, rotates the safety lever 1112 to place the lever in the fire position. The safety button 1134 therefore travels along axis 1404 when actuated.

In the safe position, the angled surface 1118 of the lever interface 1110 in the trigger 126 is in face sharing or near face sharing contact with the angled surface 1116 in the rear end 1114 of the safety lever 1112. Thus, the gap between the angle surfaces is reduced (e.g., eliminated), preventing the trigger 126 from being actuated. However, when the firearm includes the trigger block 200, shown in FIG. 2, the lever needs to be in the cocked position to allow the firearm discharge. As such, two conditions may need to be met to allow firearm discharge, in such an example, (i.e., first condition: trigger safety mechanism in the fire position, second condition: lever in cocked position). As such, the likelihood of unintended discharge of the firearm is significantly decreased, thereby increasing firearm safety. However, in other examples, the firearm may not include the trigger block 200, shown in FIG. 2, or the trigger safety mechanism 1100, shown in FIG. 14.

A safety plunger 1406 is also shown extending from a bottom side 1408 of the safety button 1134. The safety plunger 1406 functions to laterally guide the safety button 1134 in the trigger guard, during button actuation. The plunger 1406 is shown including a reduced diameter portion 1407 compactly accommodating the integration of a spring around the plunger. However, other plunger profiles may be used, in other examples.

Additionally, the safety button 1134 has a generally cylindrical shape, in the illustrated example. However, in other examples, the safety button may have a tapered shape, rectangular shape, square shape, etc.

The safety button 1134 includes recessions 1410 in the lateral sides 1138 to provide texture in the button to assist in actuation of the button. However, in other examples, the recessions 1410 may be omitted from the button design or other texturing may be provided on the lateral sides of the safety button 1134. FIG. 14 also shows the sear recess 802.

Figure 15:
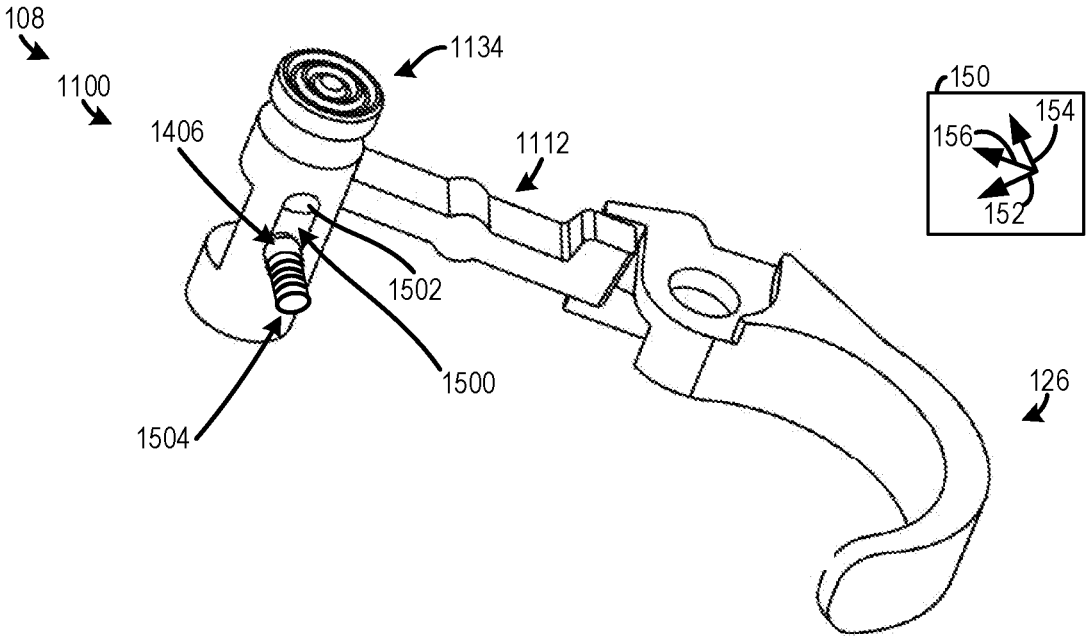

FIG. 15 shows another view of the trigger safety mechanism 1100. A plunger detent slot 1500 is shown mating with the safety plunger 1406. The plunger detent slot 1500 acts as an indexing mechanism (e.g., keyway) in that the safety plunger 1406 (e.g., spring loaded safety plunger) is the key that allows the safety button 1134 to slide between the safe and fire positions while also keeping the safety button indexed, preventing the button from rotating. In other words, the plunger detent slot 1500 guides the safety button 1134 through the transition between the safe and fire positions while also preventing rotation of the safety button. As shown, the plunger detent slot 1500 includes two extended depth indents 1502 at opposing ends of the slot 1500. The extended depth indents function to retain the safety button 1134 in the fired or safe position until a user intends to move the safety button between the fire and safe positions. Furthermore, the plunger detent slot 1500 is curved, in the illustrated example, to provide smooth button actuation. However, other profiles of the plunger detent slot 1500 have been contemplated. Additionally, the safety plunger 1406 is loaded via a safety plunger spring 1504. It will be appreciated that the safety plunger 1406 and the safety plunger spring 1504 reside in a safety plunger recess 2400 of the trigger guard 129, shown in FIG. 24. FIG. 15 also shows the trigger 126 and the safety lever 1112.

Figure 16:
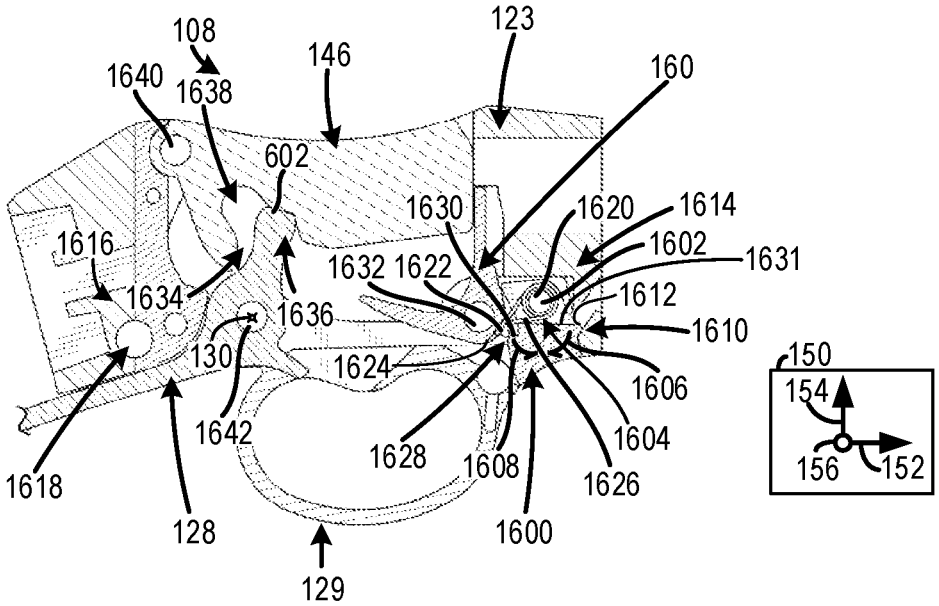
FIG. 16 shows the action body and action assembly including a disassembly latch in the firearm, shown in FIG. 1.

FIG. 16 shows a view of the action assembly 108 with the disassembly latch 1600. It will be appreciated that selected components in the action assembly 108 have been omitted to enable viewing of the disassembly latch 1600 and corresponding components.

The disassembly latch 1600 is designed to allow for efficient removal of the action assembly 108 from the action body 123. Therefore, the disassembly latch significantly increases breakdown efficiency of the action assembly and action body when compared to previous firearm designs requiring multiple pins to be knocked out of the action assembly via a hammer to break down the assembly. Conversely, reassembly of the action may also achieve increased efficiency by using the disassembly latch 1600. Furthermore, the disassembly latch 1600 can be actuated without the use of tools, in some examples, further simplifying action assembly breakdown. Specifically, in one example, the disassembly latch 1600 allows the action assembly 108 to be removed in one piece. As such, a user may quickly break down the firearm for inspection, cleaning, repair, etc. However, in other examples, removal of the action assembly 108 subsequent to disassembly lever actuation may involve removing multiple sections of the action assembly 108.

The disassembly latch 1600 is rotatable about an axis 1602 and is spring loaded via a spring 1604. The spring therefore keeps the latch in a latched position. Rotation of the disassembly latch 1600 in a first direction 1606 places the disassembly latch 1600 in an unlatched position. On the other hand, rotation of the disassembly latch 1600 in a second direction 1608 opposing the first direction 1606 transitions the latch into a latched position. It will be appreciated that the disassembly latch 1600 is in the latch position in FIG. 16. In the latched position, a latching protrusion 1610 in the disassembly latch 1600 is mated with a latching face 1612 in the action body 123. Mating between the latching protrusion 1610 and the latching face 1612 allows the action assembly 108 to be retained in the action body 123.

FIG. 16 also shows the trigger guard stop face 1614 retaining the trigger guard 129 in desired position. In this way, the trigger guard 129 may be positioned in a desired location in the action body 123. It will be appreciated that a rear side 1616 of the trigger guard 129 may be held in place via a trigger guard support pin 1618. Thus, the trigger guard stop face 1614 and the trigger guard support pin 1618 function to secure the trigger guard 129 and more generally the action assembly 108 in place with regard to the action body 123.

The spring 1604 encloses a pin 1620 (e.g., lateral pin) of the disassembly latch 1600. A first end 1622 of the spring 1604 is retained by a spring detent 1624 in the extractor 160. A second end 1626 of the spring 1604 is retained by a shelf 1631 above the rear surface 1630) in the disassembly latch 1600.

FIG. 16 shows the extractor 160 in a firing position. In the firing position a holding protrusion 1628 of the extractor 160 prevents rotation (e.g., clockwise rotation) of the disassembly latch 1600. As such, the holding protrusion 1628 in the extractor 160 is in face sharing or near face sharing contact with the rear surface 1630 of the disassembly latch 1600. In this way, the likelihood of unintended actuation of the disassembly latch 1600 may be reduced. However, it will be appreciated that in other examples, the extractor 160 may be designed such that the disassembly latch 1600 may be actuated when the extractor is in the firing position. However, in other embodiments, the action assembly 108 may not include the extractor 160.

An extractor pin 1632 is also shown in FIG. 16. The extractor pin 1632 allows the extractor 160 to rotate about a central axis of the extractor pin 1632. Furthermore, the extractor pin 1632 may be removed subsequent to release and removal of the action assembly 108. In one specific example, the extractor pin 1632 may be removed without the use of special tools.

FIG. 16 also shows the upper extension 602 in the lever 128 and the block 146. The block 146 includes a lever extension recess 1634 mating with the upper extension 602 of the lever 128. Specifically, the lever extension recess 1634 includes a cocked portion 1636 and a loading portion 1638. When the lever 128 is in the cocked position, as is the case in FIG. 16, the upper extension 602 is located in the cocked portion 1636 of the lever extension recess 1634. On the other hand, when the lever 128 is in the loading position the upper extension 602 is located in the loading portion 1638. When the lever 128 is moved from the cocked position to the loading position the upper extension 602 moves into the loading portion 1638 causing the block 146 to rotate (e.g., rotate in a clockwise direction) about a block pivot pin 1640. In this way, the block 146 pivots downwards to allow a cartridge to be guided into the chamber 120, shown in FIG. 1. FIG. 16 also shows a lever pin 1642 allowing the lever 128 to pivot about the axis 130.

Figure 18:
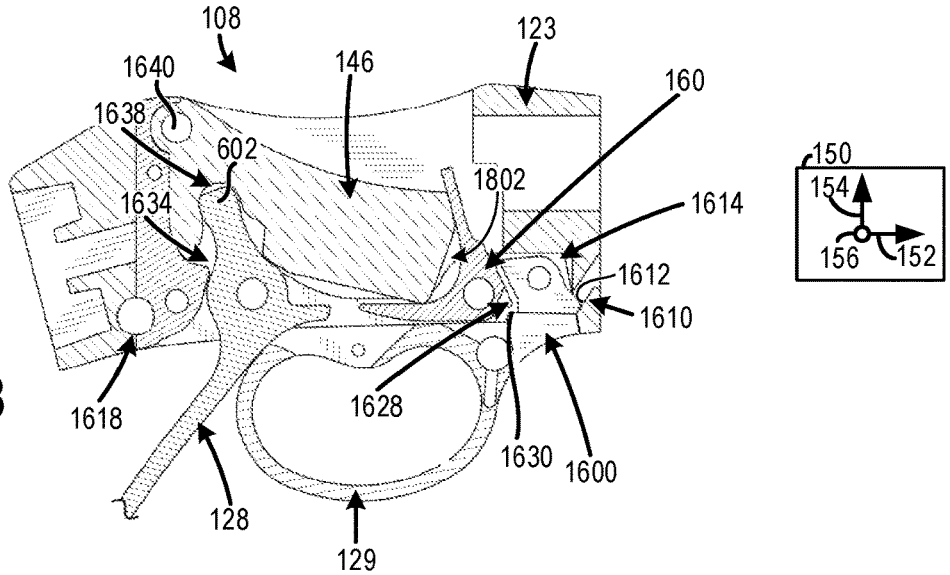

Furthermore, the action assembly 108 in FIG. 16 is in a discharge position where the assembly is configured to initiate projectile discharge responsive to a trigger pull. To elaborate, in the discharge position the striker sub-assembly 2800, shown in FIG. 28 and described in greater detail herein, may be aligned with a cartridge in the barrel. Conversely, in a loading position (e.g., reloading position), the action assembly 108 is arranged to enable cartridge removal and/or replacement from the rear chamber of the barrel. FIG. 18 shows the action assembly 108 in the loading position where the block 146 pivots down, allowing a user to access the barrel chamber.

Figure 17:
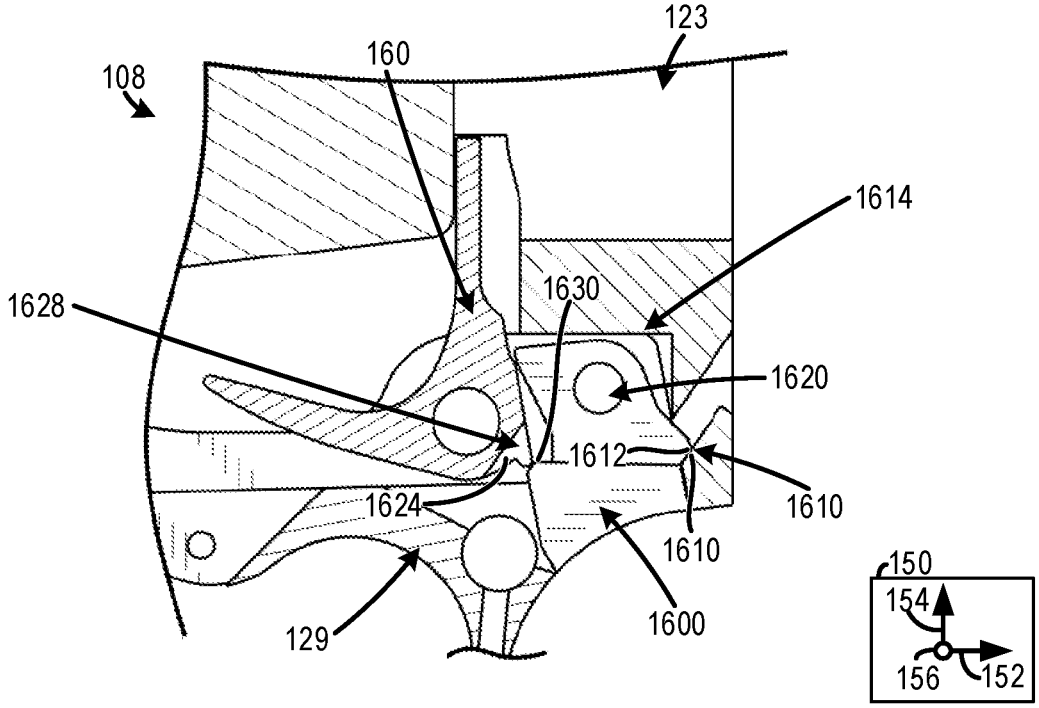
FIGS. 17-20 show an action assembly release sequence using the disassembly latch, shown in FIG. 16.

FIG. 17 shows an expanded view of the extractor 160, the disassembly latch 1600, and the trigger guard 129. As shown, the holding protrusion 1628 in the extractor 160 prevents rotational movement of the disassembly latch 1600. Thus, the holding protrusion 1628 is in contact with the rear surface 1630 of the disassembly latch 1600. The spring detent 1624 in the extractor 160 is also shown in FIG. 17. It will be appreciated that the extractor 160 and the block 146 are in the cocked position in FIG. 17. Therefore, unwanted latch actuation when intending to discharge the firearm may be avoided. However, in other examples, the extractor 160 may not block movement of the disassembly latch 1600.

FIG. 17 also shows the trigger guard stop face 1614 in the action body 123 mating with a portion of the trigger guard 129. Additionally, FIG. 17 shows the latching protrusion 1610 in the disassembly latch 1600 mating with the action body latching face 1612 in the action body 123. FIG. 17 also shows the pin 1620 about which the disassembly latch 1600 pivots.

Figure 19:
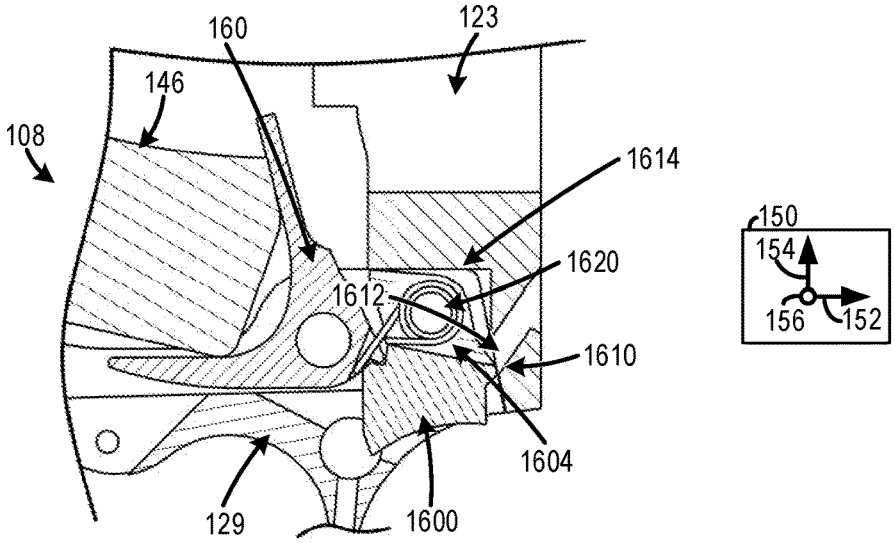
Figure 20:
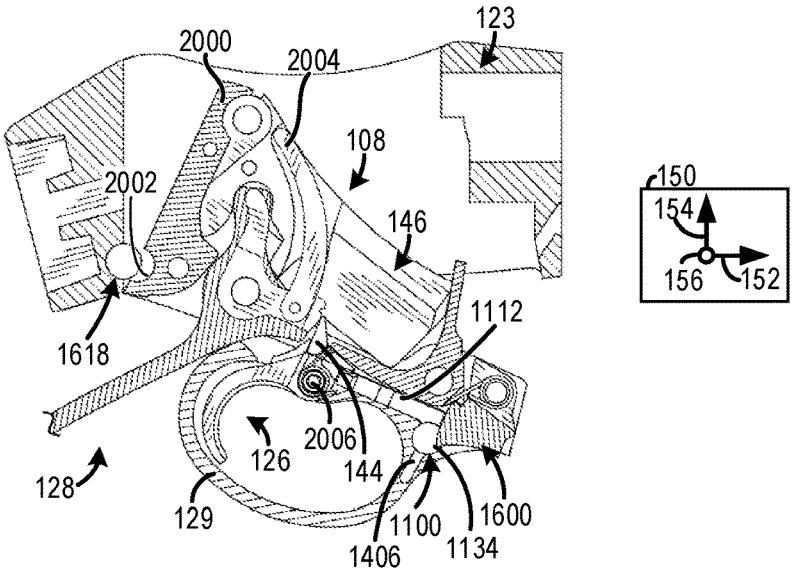

FIGS. 18-20 illustrate a sequence where the disassembly latch 1600 is actuated and the action assembly 108 is removed from the action body 123. It will be appreciated that such a sequence may be implemented by a user without the use of tools, if desired. Consequently, the action assembly 108 may be quickly and efficiently removed from the action body, allowing for cleaning, repair, etc., of the action assembly.

Specifically, FIG. 18 depicts the extractor 160 placed in the extracted position. In the extracted position the holding protrusion 1628 in the extractor 160 is moved away from the rear surface 1630 of the disassembly latch 1600 such that the latch can freely rotate (e.g., rotated in a clockwise direction). It will be appreciated that movement of the lever 128 into the extracted position places the extractor 160 and the block 146 in the extracted position. As previously discussed, in the extracted position the block is rotated (e.g., clockwise rotated) such that a front side 1802 of the block 146 drops down and extracts a cartridge.

FIGS. 38-39 show the extractor 160 in the loading and extracted positions, respectively. Specifically, as shown in FIG. 38 a cartridge 3800 is positioned in the chamber 120. On the other hand, in FIG. 39 fingers 3900 in the extractor 160 urge the cartridge 3800 rearward out of the chamber 120 to facilitate cartridge removal. Returning to FIG. 18 also illustrating the latching protrusion 1610 in the disassembly latch 1600 mating with the latching face 1612 in the action body 123. FIG. 18 also depicts the trigger guard stop face 1614 limiting movement of the trigger guard 129.

In FIG. 18, the upper extension 602 in the lever 128 mates with the loading portion 1638 of the lever extension recess 1634 in the block 146. The interaction between the upper extension 602 and the loading portion 1638 causes the rotational movement of the block 146 into the loading position. Thus, counterclockwise rotation of the lever 128 causes clockwise rotation of the block 146 about the block pivot pin 1640. FIG. 18 also shows the trigger guard support pin 1618.

FIG. 19 shows the disassembly latch 1600 rotated into the unlatched position. The pin 1620 retaining the disassembly latch 1600 in the trigger guard 129 allows the latch to pivot. In the unlatched position, the latching protrusion 1610 in the disassembly latch 1600 is spaced away from the latching face 1612 in the action body 123. It will be appreciated that the spring 1604 may be loaded to resist movement of the disassembly latch 1600 into the unlatched position to allow for efficient re-engagement of the disassembly latch 1600. After the disassembly latch 1600 is placed in the unlatched position the action assembly 108 may be rotated in a clockwise direction to allow the action assembly to be removed from the action body 123. FIG. 19 also shows the extractor 160 and the trigger guard 129 engaged with the trigger guard stop face 1614.

FIG. 20 illustrates the action assembly 108 and the action body 123 subsequent to disassembly latch 1600 disengagement and rotation of the action assembly 108. As shown, the removable block support 2000 includes a concave surface 2002 spaced away from the trigger guard support pin 1618. Subsequent to rotation of the action assembly 108 may cause the assembly to drop out of the action body 123 to facilitate inspection, cleaning, repair, etc., of the action.

FIG. 20 additionally depicts a cocking indicator 2004. The cocking indicator 2004 is designed to give the operator of the firearm a visual indicator as to when the striker and striker spring are preloaded and the firearm is cocked.

Figure 40:
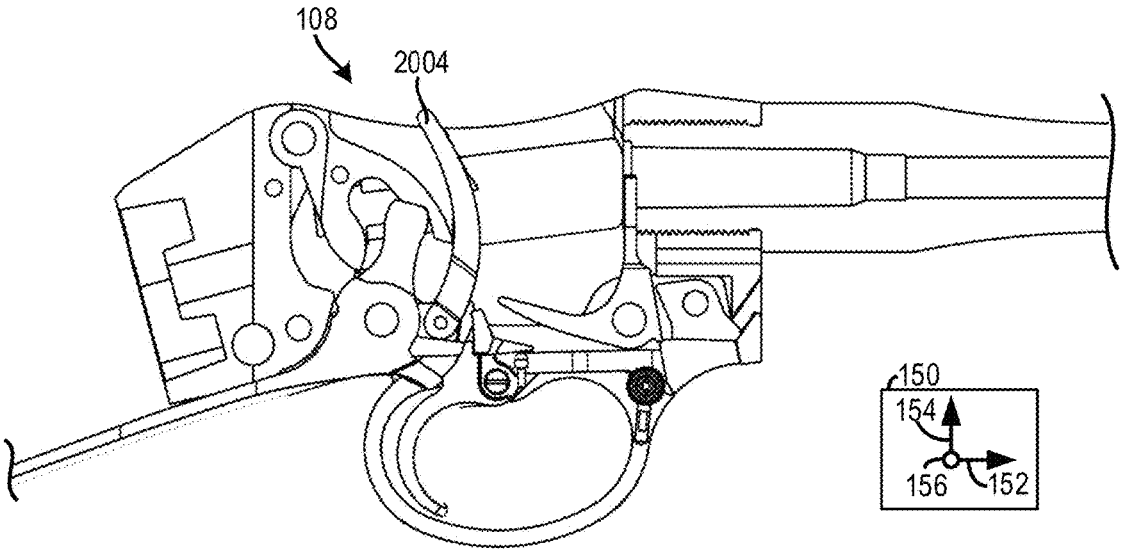
FIGS. 40-41 show the action assembly in the firearm, shown in FIG. 1, in a cocked and fired position, respectively.
Figure 41:
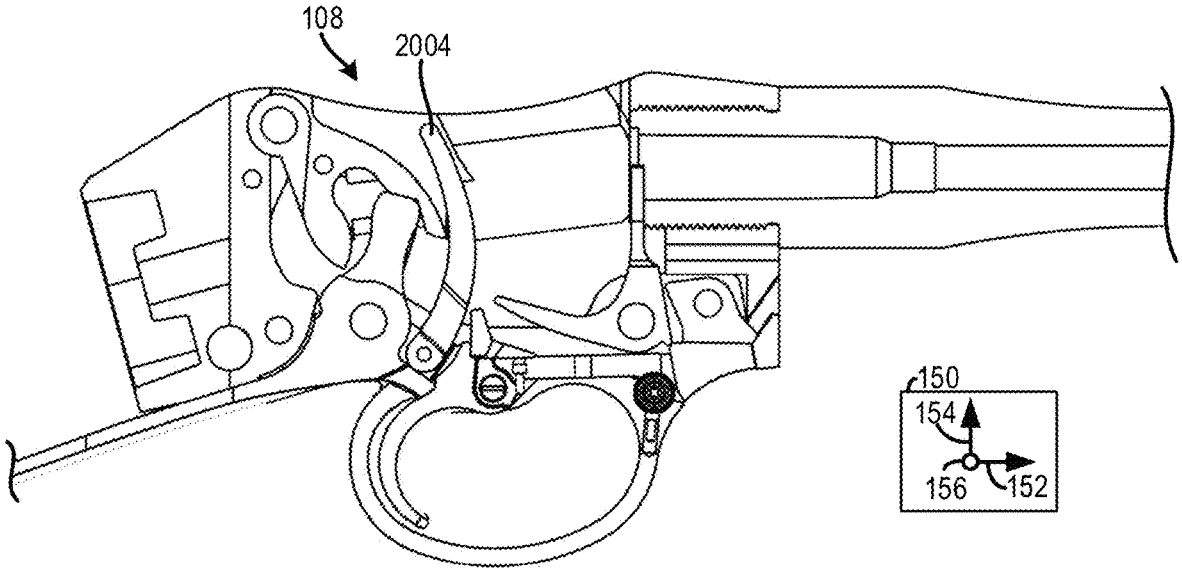

FIGS. 40-41 show the action assembly 108 in the cocked and fired configurations, respectively. As shown, the cocking indicator 2004 moves up and down. Therefore, in the cocked configuration the cocking indicator 2004 is visible by the user. On the other hand, in the fired configuration, the cocking indicator 2004 is hidden from view. Consequently, a user can quickly identify when the action is in the cocked configuration or the fired configuration. In other examples, the cocking indicator may be omitted from the action assembly.

FIG. 20 also shows a trigger screw 2006 securing the trigger 126 and sear 144 to the trigger guard 129. However, in other examples a removable pin may be used to secure the trigger to the trigger guard.

Additionally, the trigger safety mechanism 1100 is shown in FIG. 20. As previously discussed, the trigger safety mechanism 1100 includes the user actuatable safety button 1134. Actuation of the safety button into the safe position causes actuation of the safety lever 1112 which blocks actuation of the trigger 126. The safety plunger 1406 included in the trigger safety mechanism 1100 is also shown in FIG. 20.

Figure 21:
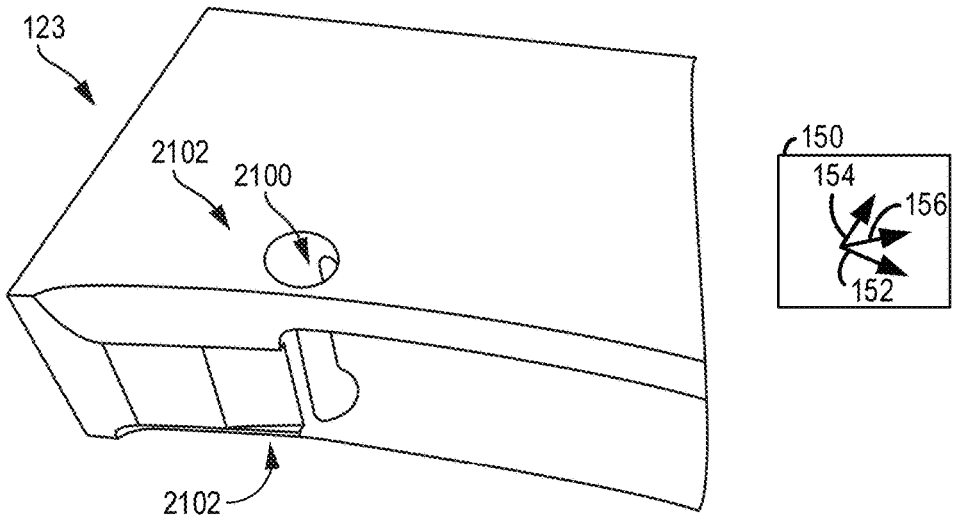
FIG. 21 shows an example of the action body, shown in FIG. 1, including a trigger guard support pin opening.
Figure 22:
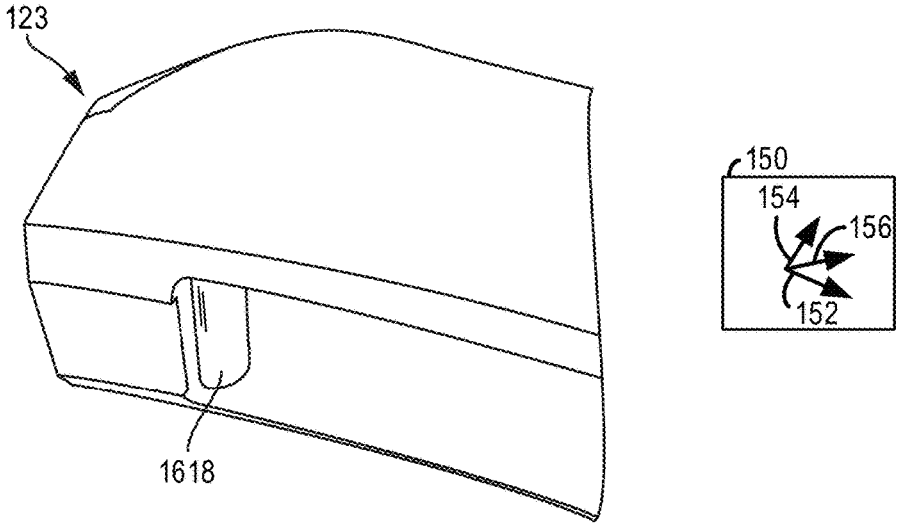
FIG. 22 shows the action body depicted in FIG. 21 with a trigger guard support pin assembled therein.

FIGS. 21-22 are images of a manufacturing sequence of the action body 123. Specifically, FIG. 21 shows an example of the action body 123 without the trigger guard support pin. A support pin opening 2100 is provided in the action body 123 to allow insertion of the trigger guard support pin therein. The support pin opening 2100 laterally extends through the action body 123 and between opposing lateral sides 2102 of the action body. However, other support pin arrangements may be used, in other embodiments.

Figure 35:
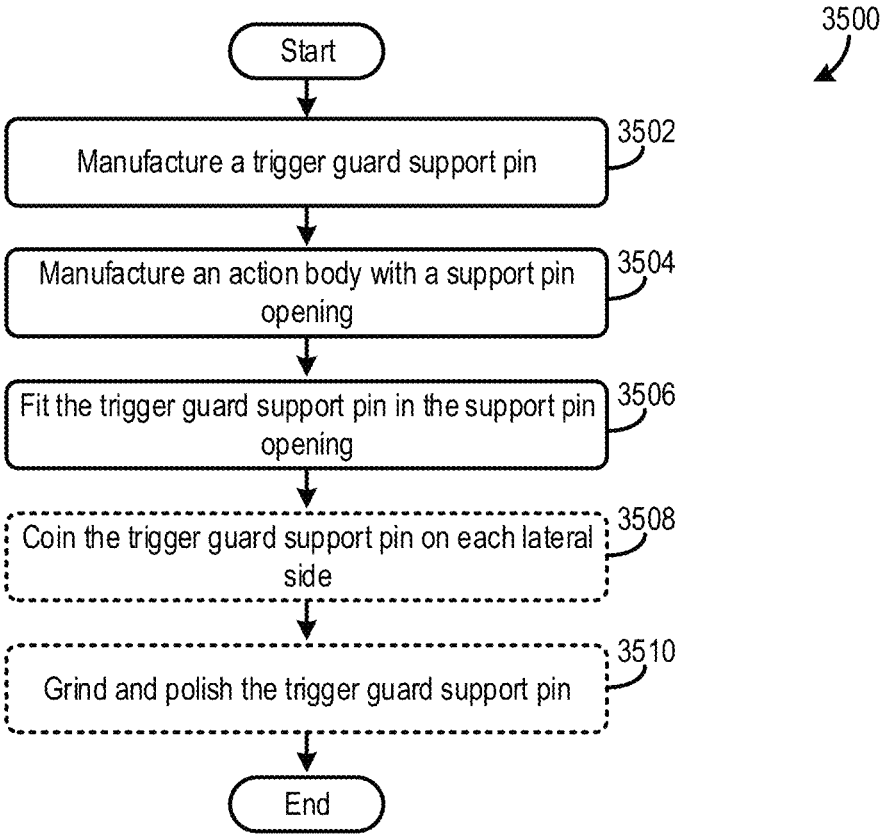
FIG. 35 shows a method for manufacturing an action body in a firearm.

FIG. 22 shows an example of the action body 123 with the trigger guard support pin 1618 inserted into the support pin opening 2100, depicted in FIG. 21. It will be appreciated that the trigger guard support pin 1618 may be coined after insertion into the support pin opening 2100, shown in FIG. 21, in some examples. A manufacturing method for the action body 123 is shown in FIG. 35 and described in greater detail herein.

Figure 23:
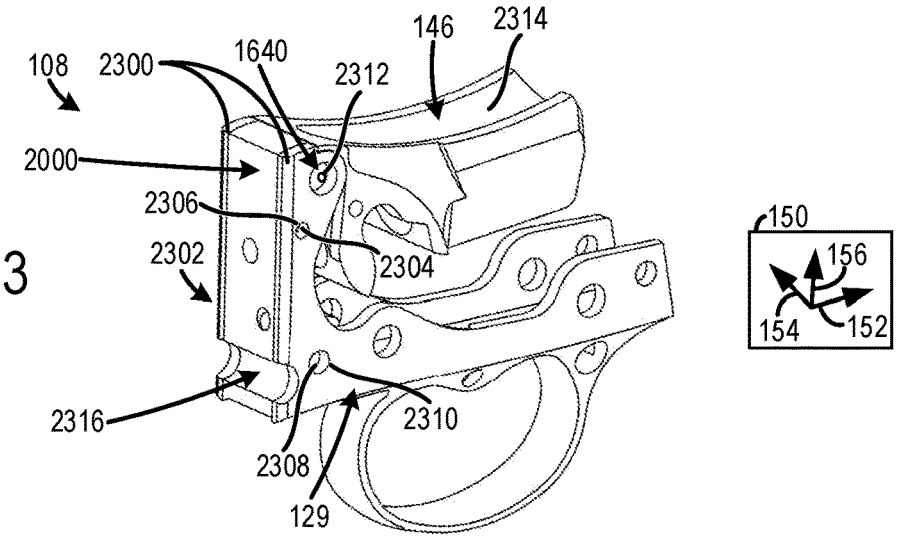
FIGS. 23-27 show different views of a removable block support in the action assembly of the firearm, shown in FIG. 1.

FIGS. 23-27 show illustrations of the removable block support 2000 in the action assembly 108. Specifically, FIG. 23 shows a perspective view of a portion of the action assembly 108. The removable block support 2000 is laterally positioned between sections 2300 (e.g., lateral sections) of the trigger guard 129. A plurality of pins 2302 attach the removable block support 2000 to the trigger guard 129, in the illustrated example. To elaborate, an upper pin 2304 extends through an upper opening 2306 to attach the removable block support 2000 to the trigger guard 129. Additionally, a lower pin 2308 extends through a lower opening 2310. Providing a plurality of pins in the action assembly secures the removable block support 2000 to the trigger guard 129. This connection between the removable block support 2000 and the trigger guard 129 allows the firing load (e.g., substantially all of the firing load) to be transferred through the removable block support to the back of the action when compared to previous Martini-Henry rifle designs. As a result, the likelihood of action assembly damage caused by overloading is reduced. It will be appreciated that a single pin or more than two pins may be used to attach the removable block support to the trigger guard, in other examples. The plurality of pins 2302 are cylindrical in shape. However, other pin contours have been envisioned. For instance, the pins may include chamfered ends, tapered ends, etc. Further in other examples, additional or alternative attachment techniques between the removable block support 2000 and the trigger guard 129, have been contemplated such as screws, dovetails, keys, clamps, etc.

Additionally, the block pivot pin 1640 is shown connecting the block 146 to the trigger guard 129. The block pivot pin 1640 extends through an opening in the block 146. It will be appreciated that the block pivot pin 1640 allows the block 146 to be rotated about an axis 2312 to place the block in the firing position, shown in FIG. 23, or in a loading position. As previously discussed, in the loading position an upper surface 2314 of the block 146 guides a cartridge into the chamber 120 in the firearm 100, illustrated in FIG. 1. As shown in FIG. 23, the upper surface 2314 is curved with regard to the longitudinal and lateral axes to allow the cartridge to be smoothly guided into the action body 123, shown in FIG. 16. However, other contours of the block 146 have been contemplated.

FIG. 23 also depicts a curved surface 2316 mating with the trigger guard support pin 1618, shown in FIG. 16. Thus, the curved surface 2316 holds the back of the action assembly securely in the action body 123.

FIG. 24 shows a cross-sectional view of the action assembly 108 with a portion of the trigger guard 129 removed to reveal the contours of the removable block support 2000. It will be appreciated, that the trigger guard 129 and action body 123 shown in FIG. 24 is in cross-section.

Again, the plurality of pins 2302 connecting the removable block support 2000 to the trigger guard 129, are shown. Additionally, the block pivot pin 1640 and the trigger guard support pin 1618 are illustrated.

FIG. 24 also shows the safety plunger recess 2400 and the safety button opening 2402, in the trigger guard 129. The safety plunger recess 2400 functions to limit the movement of the safety plunger 1406, shown in FIG. 15. Additionally, the safety button opening 2402 guides lateral movement of the safety button 1134, shown in FIG. 15.

FIG. 24 also shows the fulcrum opening 2404 in the trigger guard 129. The fulcrum opening 2404 retains the fulcrum of the safety lever 1112, depicted in FIG. 14.

Furthermore, the plurality of pins 2302 and the block pivot pin 1640, shown in FIG. 24 as well as the extractor pin 1632, the pin 1620, and the lever pin 1642, shown in FIG. 16, may be designed to be efficiently removed from the action assembly 108. For instance, a user may use a finger or a bullet tip to push the pins out (e.g., laterally out) of the action assembly. As such, the aforementioned pins may have a decreased interference fit between the corresponding openings due to the lateral walls 2406 of the action body 123 that retain the pins in place when the action assembly 108 is assembled with the action body 123. In some specific examples, the interference fit between the pins and the openings may be substantially eliminated due to the lateral walls of the action body retaining the pins when the firearm is assembled. In one use-case example, there may be approximately 0.001 inches (in) of clearance on the pins so they can be removed without tools. Further in some examples, the two pins that hold the removable block support to the trigger guard may have slight interference as the removable block support does not need to be removed for cleaning. As a result, assembly/disassembly efficiency is further increased. For instance, the action assembly may be torn down for cleaning, repair, etc., and quickly reassembled without the use of tools and/or with a cartridge.

Figure 25:
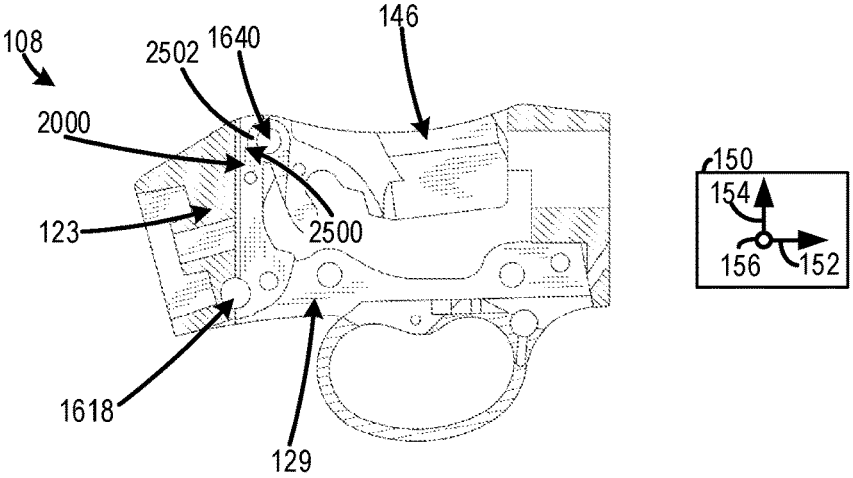

FIG. 25 illustrates a side view of the action assembly 108 shown in FIG. 24. The removable block support 2000 includes block indent 2500 mating with a curved section 2502 of the block 146 adjacent to the block pivot pin 1640. The mating allows loads generated during cartridge discharge in the firearm to be transferred from the block 146 to the removable block support 2000 and then subsequently to the action body 123. In this way, firing loads may be transferred to a stronger part in the action assembly 108 when compared to previous Martini-Henry rifles transferring loads from the block to the block pivot pin. Consequently, the strength of the action assembly is increased. FIG. 25 also shows the action body 123, trigger guard support pin 1618, and trigger guard 129.

Figure 26:
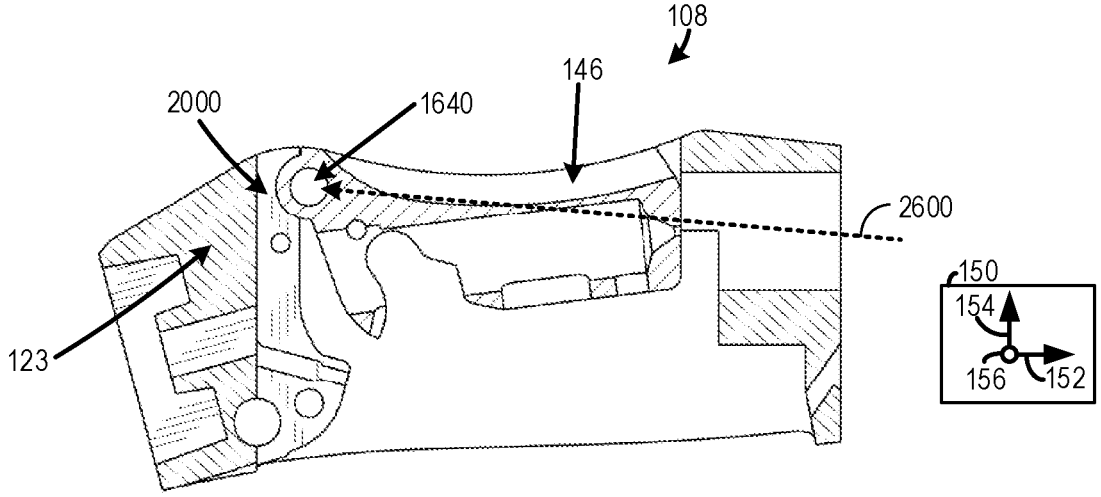

FIG. 26 shows another side view of the action assembly 108. Again, the block 146, removable block support 2000, the action body 123, and the block pivot pin 1640 are illustrated. The force 2600 transferred through the block 146 into the block pivot pin 1640 and then the removable block support 2000 and then the action body 123, is indicated in FIG. 26.

Figure 27:
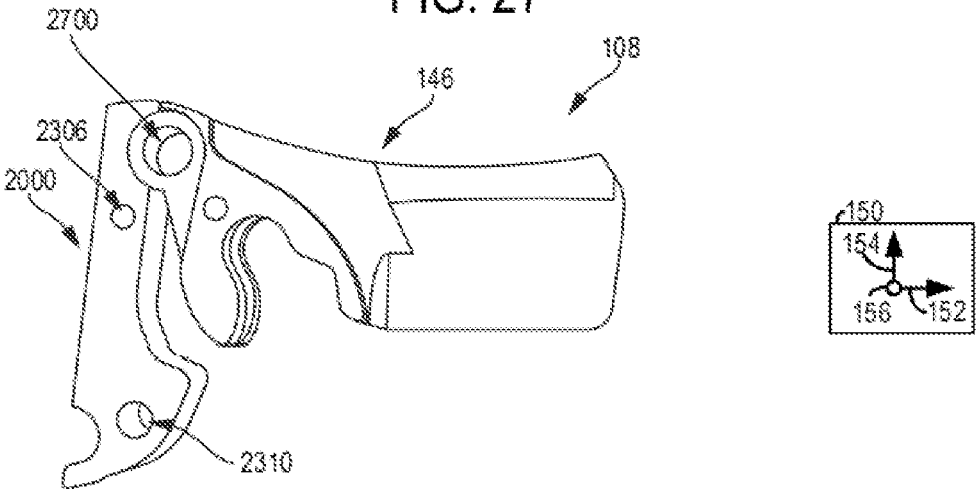

FIG. 27 depicts a view of the removable block support 2000 and the block 146 in the action assembly 108. The pins are removed in the view shown in FIG. 27. FIG. 27 shows the openings 2306 and the opening 2310 without the pins inserted therein. A block pivot pin opening 2700 is also depicted in FIG. 27.

Figure 28:
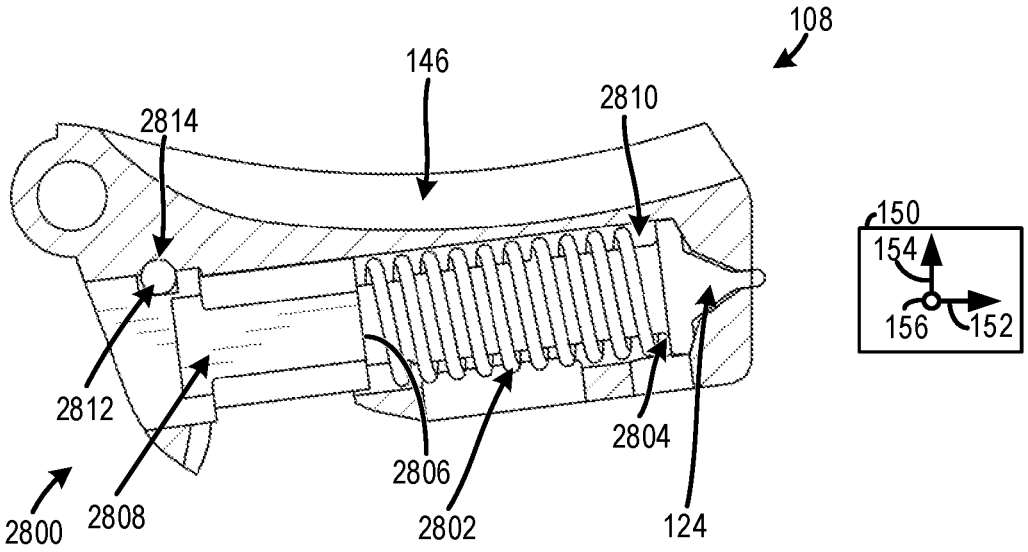
FIGS. 28-29 show a striker sub-assembly in the action assembly of the firearm, shown in FIG. 1.
Figure 29:
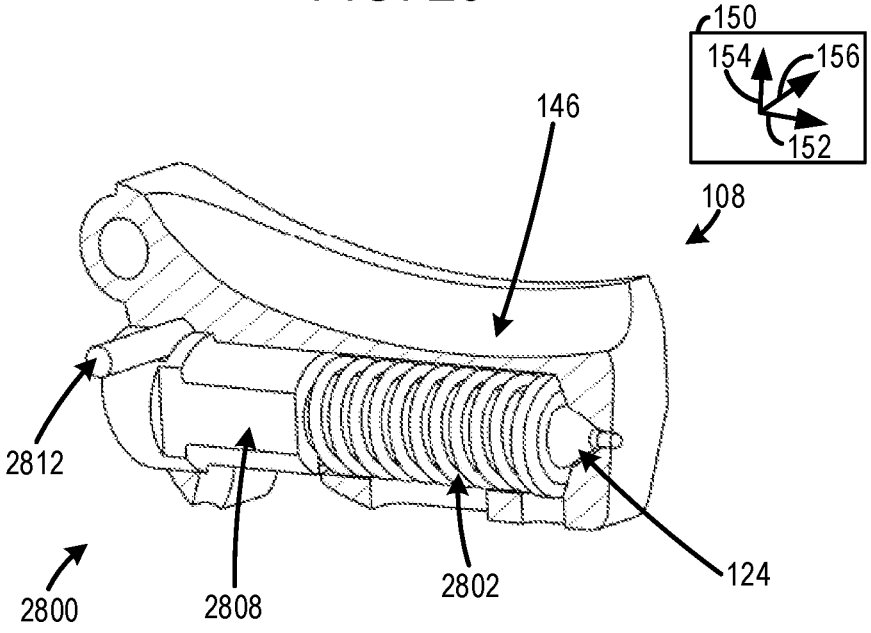

FIGS. 28-29 show the striker sub-assembly 2800 in the block 146 of the action assembly 108 where a portion of the block 146 is cut-away to reveal the sub-assembly. The striker sub-assembly 2800 is designed to be placed in a cocked position and a discharged position. The striker sub-assembly 2800 is shown in a discharged position in FIGS. 28 and 29. In the discharged position, the striker 124 is not pre-loaded via the striker spring 2802. On the other hand, in the cocked position the striker 124 is pre-loaded and readied for firing. As previously discussed, the upper extension 145 in the tumbler 142, shown in FIG. 1, interacts with the striker sub-assembly 2800 to place the sub-assembly in the cocked and discharged positions. Specifically, the tumbler 142, shown in FIG. 1, may interact with an opening 147, shown in FIG. 1, in the striker 124 to retract the striker when the tumbler is cocked.

FIG. 28 illustrates the striker spring 2802 longitudinally delimited by a striker flange 2804 and a front surface 2806 of a striker stop 2808. The striker spring 2802 also circumferentially surrounds a body 2810 of the striker 124. In this way, the striker spring 2802 may be compactly integrated into the striker sub-assembly 2800. However, other striker pin arrangements may be used, in other examples.

A striker stop pin 2812 is also shown in FIG. 28 extending through an opening 2814 in the striker stop 2808. The striker stop pin 2812 and corresponding opening 2814 may be sized to allow the striker stop pin to be removed by hand during striker sub-assembly disassembly. Specifically, in one instance, a user may press on the striker stop 2808 and/or use a bullet tip to press on the striker stop pin 2812 to remove the pin, if desired. In this way, the speed at which the action assembly 108 can be broken down and re-assembled is increased, when compared to previous striker assemblies utilizing screws to retain the striker stop in a desired location in the block.

FIG. 29 shows an isometric view of the striker sub-assembly 2800 in the block 146 of the action assembly 108. Again, the striker stop pin 2812, striker stop 2808, striker spring 2802, and striker 124, are illustrated.

Figure 30:
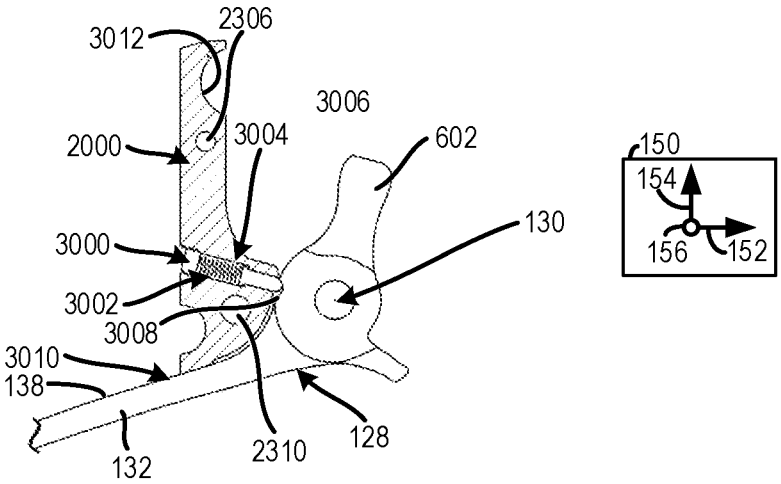
FIGS. 30-31 show a spring loaded catch plunger in the removable block support of the firearm, shown in FIG. 1.
Figure 31:
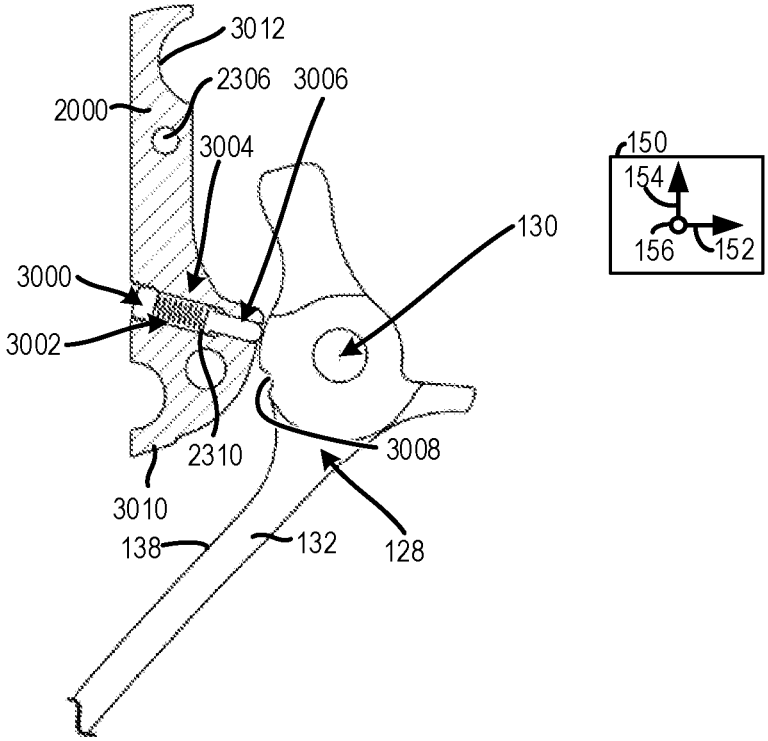

FIGS. 30-31 show the removable block support 2000 with components for dampening cocking action in handle 132 of the lever 128. In particular, a set screw 3000 loaded via a spring 3002 is shown positioned in a channel 3004 in the removable block support 2000. A catch plunger 3006 loaded via the spring 3002 mates with a detent 3008 in the upper extension 602 of the lever 128 when the lever is in the cocked position, as shown in FIG. 30. The removable block support 2000 also includes the lever stop surface 3010 in contact with the upper surface 138 of the lever handle 132, as shown in FIG. 30. The lever stop surface 3010 and the spring loaded catch plunger 3006, shown in FIGS. 30-31, work in conjunction to reduce noise and vibration in the firearm during lever actuation. Specifically, the lever stop surface 3010 is profiled such that contact between the lever and the stock 106, shown in FIG. 1, are inhibited. Additionally, the spring loaded catch plunger 3006 dampens the lever 128 during lever actuation, thereby reducing noise experienced during lever cocking. Additionally, the axis 130 about which the lever 128 pivots, is shown in FIGS. 30-31. The catch plunger 3006 and the detent 3008 function to hold the lever 128 up in the block closed position. Consequently, the problem of a noisy lever/butt catch design found in previous Martini-Henry rifles may be remedied (e.g., eliminated).

FIG. 30 shows the lever 128 in the cocked position (e.g., fully cocked) while FIG. 31 shows the lever 128 in a loading position. In the loading position, shown in FIG. 31, the lever handle 132 is spaced away from the lever stop surface 3010 in the removable block support 2000.

FIGS. 30-31 show the openings 2306 and 2310 in the removable block support 2000 designed to receive pins. Additionally, a curved surface 3012 interacting with the rear of the block 146, shown in FIG. 29, is also depicted in FIGS. 30-31.

Figure 32:
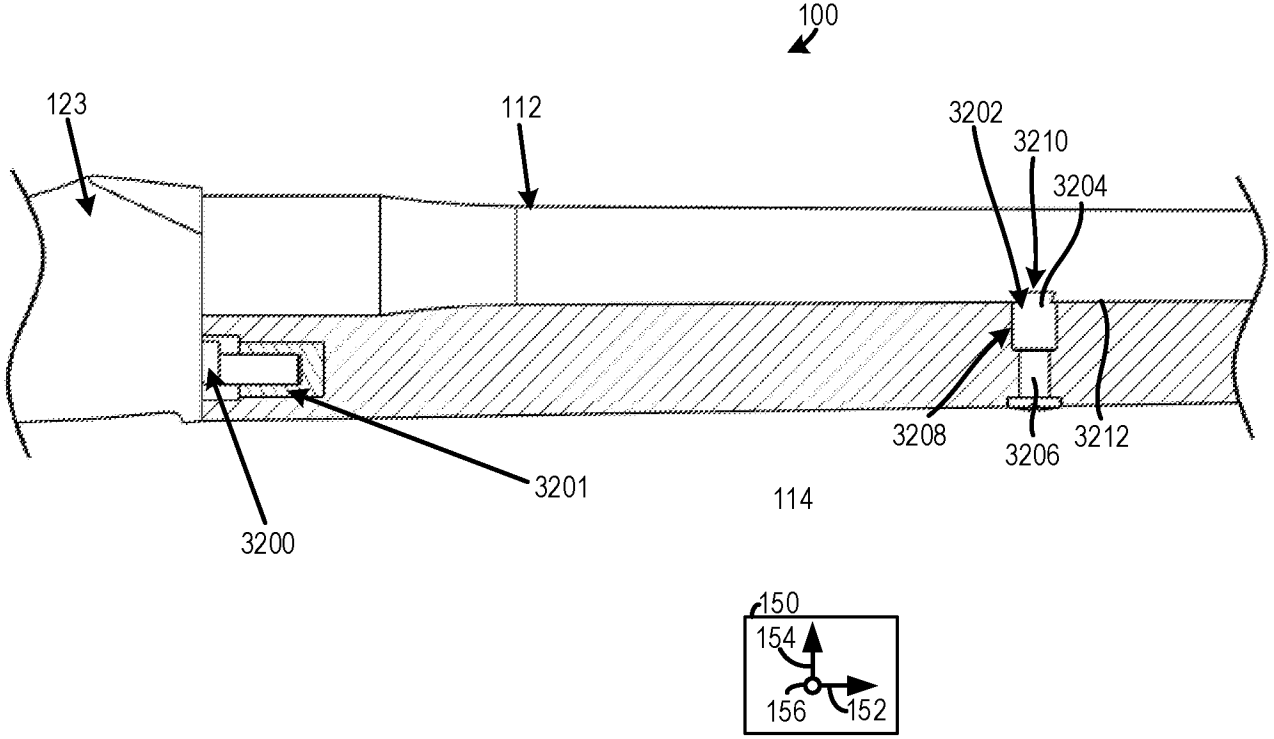
FIGS. 32-34 show a depiction of an action body, barrel, and forearm included in the firearm, shown in FIG. 1.

FIG. 32 illustrates the interface between the barrel 112, forearm 114, and the action body 123 in the firearm 100. It will be appreciated that due to the configuration of the firearm 100 the action body 123 and forearm 114 may be attached to one another. Specifically, a forearm bracket 3200 connects the action body 123 to the forearm 114. The forearm bracket 3200 is at least partially surrounded via a compliant bushing 3201 (e.g., rubber bushing). Thus, the compliant bushing 3201 receives the forearm bracket 3200 and allows for some forward/backward movement between the bushing and the bracket. The compliant bushing may be constructed out of 90 shore rubber, in one example, to provide desired dampening characteristics. However, outer suitable compliant bushing materials have been contemplated such as plastic, phenolic laminate, etc.

The compliant material reduces the chance of damage to the forearm 114 caused by external forces (e.g., dropping the firearm) as well as provides acoustic dampening during firearm discharge. The forearm 114 is attached to the barrel 112 in the firearm 100. An attachment apparatus 3202 is used to attach the forearm 114 to the barrel 112. In the illustrated example, the attachment apparatus 3202 includes a forearm mounting lug 3204 and a forearm screw 3206 threading into the forearm mounting lug. However, other types of attachment apparatuses have been envisioned. The forearm mounting lug 3204 extends through an opening 3208 in the forearm 114 and includes a first end 3210 attached to an outer surface 3212 of the barrel 112.

Figure 33:
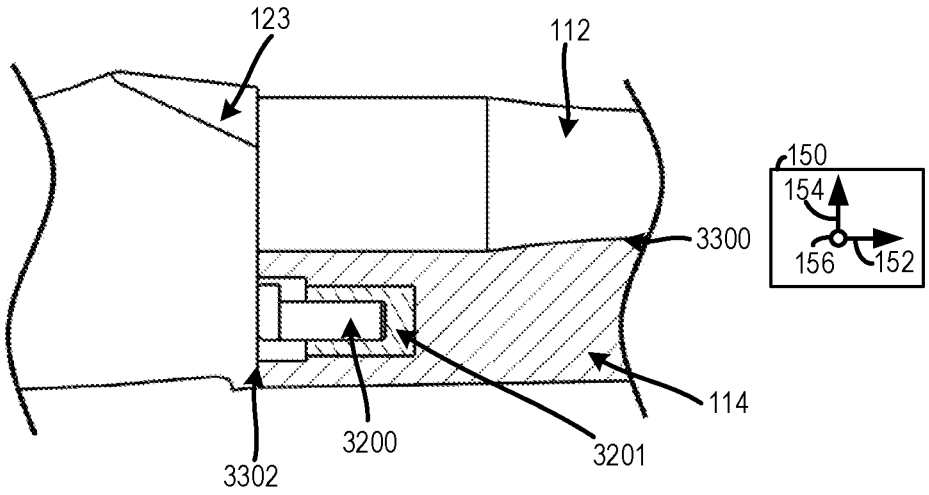

The forearm mounting lug 3204, shown in FIG. 32, sets a gap 3300 between the barrel 112 and the forearm 114, as shown in FIG. 33. The gap 3300 accommodates for thermal changes in the size of the barrel during use of the firearm. As a result, changes in the relative position between the barrel 112 and the forearm 114 can be reduced, thereby improving firearm accuracy.

The forearm bracket 3200 sets a gap 3302 between the forearm 114 and the action body 123, as shown in FIG. 33. The gap 3302 functions to accommodate for changes in the size of the action body 123 and the stock 106, shown in FIG. 1, caused by thermal changes in the components. In this way, misalignment between the action body 123 and the forearm 114 may be reduced, thereby increasing firearm accuracy.

Figure 34:
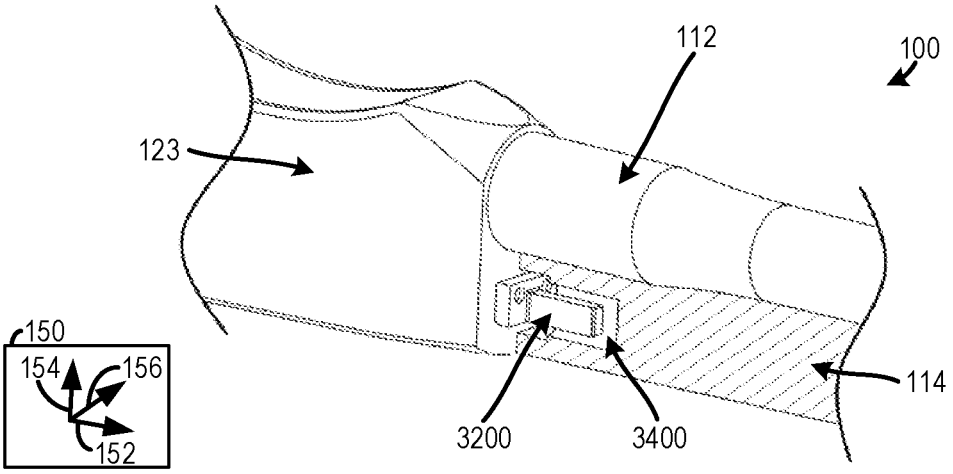

FIG. 34 is an isometric view of the section of the firearm 100, depicted in FIG. 33. Again the action body 123, barrel 112, and forearm 114 are illustrated. The compliant bushing (e.g., rubber bushing) is omitted in FIG. 34 at 3400. As shown in FIG. 34, the forearm bracket 3200 has a rectangular shape that protrudes into the compliant bushing. The bracket's rectangular geometry prevents the rear portion of the forearm 114 from rotating on its lengthwise axis. However, other forearm bracket shapes may be used, in other examples.

It will be appreciated that the gaps 3300 and 3302, shown in FIG. 33, may be particularly useful when the forearm 114 is formed from wood due the wood's volumetric change caused by changes in temperature and/or moisture content. However, as previously discussed, the forearm may be constructed out of other suitable materials.

FIG. 35 shows a method 3500 for manufacturing a trigger guard in a firearm. It will be appreciated that the method 3500 may be used to manufacture the trigger guard in the firearm discussed above with regard to FIGS. 1-34. However, in other examples, the method 3500 may be used to manufacture other suitable trigger guards. Additionally, at least a portion of the method 3500 and the other methods described herein may be implemented via manufacturing apparatuses. The manufacturing apparatuses may be equipped with controllers including code stored in memory (e.g., non-transitory memory) executable by a processor to carry out the steps, actions, etc., described with regard to the method(s). It will also be appreciated that a portion of the steps in method 3500 as well as the other methods described herein may be manually implemented, in some instances.

At 3502 the method includes manufacturing a trigger guard support pin. In one example, the trigger guard support pin may be cast, machined, 3-D printed, etc. Further in one example, the pin may be cylindrical. However, other pin shapes may be used, in other examples.

Next at 3504 the method includes manufacturing an action body with a support pin opening. It will be appreciated that the support pin opening may have a profile allowing the trigger guard support pin to be inserted therein. The action body may be cast, machined, 3-D printed, etc.

At 3506 the method includes fitting the trigger guard support pin in the support pin opening. For instance, the trigger guard support pin may be press fit into the support pin opening. However, other suitable techniques for fitting the trigger guard support pin into the support pin opening have been contemplated.

At 3508 the method may include coining the trigger guard support pin on each lateral side of the pin. Coining involves precision stamping where the pin is subjected to a sufficiently high stress to induce plastic flow on the surface of the material. Coining has several benefits such as reducing surface grain size and hardening the surface of the pin while allowing metal deeper in the pin to retain its ductility and toughness and enlarging the lateral sides of the pin producing an extremely tight and tough interference fit between the pin and the action body. In other examples, step 3508 may not be included in the method.

At 3510 the method may include grinding and polishing the trigger guard support pin and the action body. In this way, the interface between the pin and the action body may be smoothed. However, in other examples, step 3510 may be omitted from the method.

Method 3500 allows the trigger guard support pin to be separately manufactured from the action body and then subsequently fitted into the action body. As a result, manufacturing efficiency of the action body may be increased when compared to an action body with a curved trigger guard support cast or machined therein. As a result, the cost of manufacturing the action body is driven down.

Figure 36:
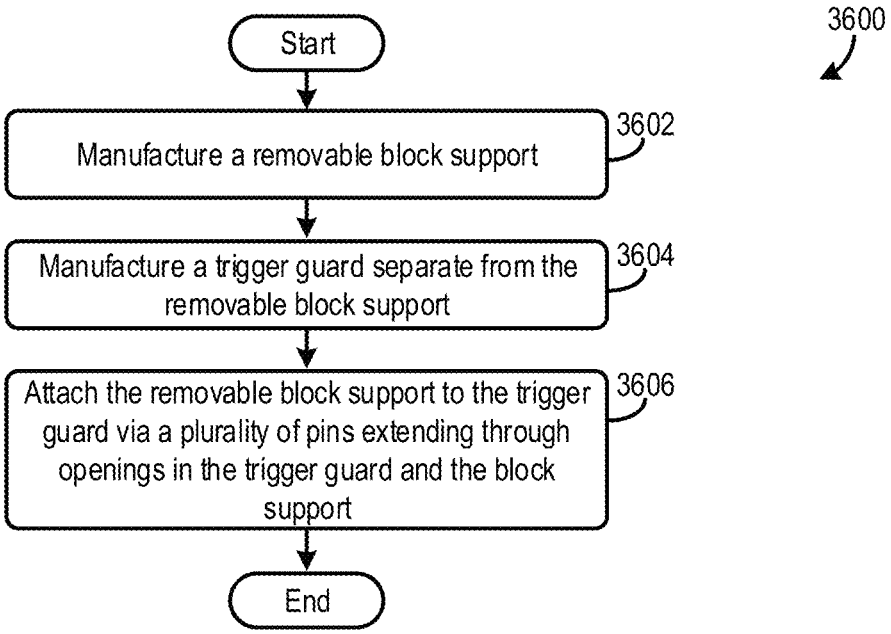
FIG. 36 shows a method for manufacturing a removable block support and a trigger guard in a firearm.

FIG. 36 illustrates a method 3600 for manufacturing a trigger guard and removable block support. It will be appreciated that the method 3600 may be used to manufacture the trigger guard in the firearm discussed above with regard to FIGS. 1-34. However, in other examples, the method 3600 may be used to manufacture other suitable trigger guards.

At 3602 the method includes manufacturing a removable block support. Manufacturing the removable block support may include machining, casting, combinations thereof, etc., the removable block support. The removable block support may include openings sized to receive pins.

Next at 3604 the method includes manufacturing a trigger guard separate from the removable block support. Manufacturing the trigger guard may include machining, casting, combinations thereof, etc., the trigger guard. The trigger guard may include two lateral walls spaced away from one another. The gap between the lateral walls is sized to mate with the removable block support. Additionally, the trigger guard may include an opening that is lined up with the openings in the removable block support.

Next at 3606 the method includes attaching the removable block support to the trigger guards via a plurality of pins extending through openings in the trigger guard and the removable block support. For example, a user may push the pins into the pin openings. Method 3600 allows the removable block support to be efficiently manufactured in conjunction with the trigger guard to decrease firearm manufacturing costs.

Figure 37:
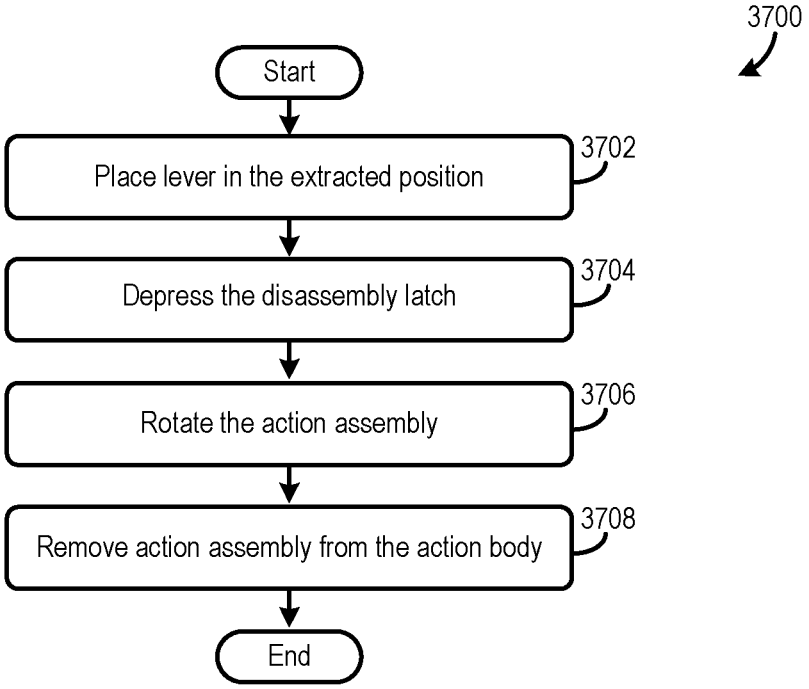
FIG. 37 shows a method for disassembly of an action assembly and action body in a firearm.

FIG. 37 depicts a method 3700 operating a firearm. The method may be implemented via the firearm discussed above with regard to FIGS. 1-34. However, in other examples the method 3700 may be implemented using another suitable firearm.

At 3702 the method includes placing the lever in an extracted configuration. Thus, the lever may be rotated away from the stock to allow for rotation of the block downward to allow the firearm to be in the cartridge extracted position, shown in FIG. 18.

At 3704 the method includes depressing the disassembly latch. Depressing the disassembly latch rotates a latching protrusion in the latch away from a latching face in the action body. As such, the action assembly may be moved away from the action body.

At 3706 the method includes rotating the action assembly. In this way, the front of the action assembly may drop out of the action body, allowing for rapid and efficient removal of the action assembly.

At 3708 the method includes removing the action assembly from the action body. Removing the action assembly may include moving the removable block support away from the trigger guard support pin. As previously discussed, the action assembly may be removed as a single unit, in some examples. Consequently, action breakdown in the firearm may be simplified to increase firearm assembly/disassembly efficiency. Method 3700 therefore allows for quick and efficient disassembly of the action from the body. Furthermore, it will be appreciated that to assemble the action body with the action the method may be carried out in reverse.

FIGS. 1-34 and 38-41 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention will further be described in the following paragraphs. In one aspect, a firearm is provided that comprises a safety mechanism including: an actuatable lever including a first side interacting with a lever interface in a trigger to inhibit actuation of the trigger in a safe configuration; and a safety button including a detent mating with a second side of the actuatable lever; where the actuatable lever is pivotable about a fulcrum in front of the trigger; and where actuation of the trigger causes firearm discharge.

In another aspect, a firearm is provided that comprises a trigger including a trigger blocking flange positioned on a rear side of the trigger; where the trigger blocking flange prevents actuation of the trigger when a lever in an action assembly is in a partially cocked configuration; where the lever is configured to be placed in a fully cocked position where a sear is engaged with a tumbler and a loading configuration where the action assembly is configured for projectile loading.

In another aspect, a firearm is provided that comprises a safety mechanism including an actuatable lever interacting with a lever interface in a trigger to prevent trigger actuation in a safe configuration; where the actuatable lever is pivotable about a fulcrum in front of the trigger; where the trigger includes a trigger blocking flange positioned on a rear side of the trigger; and where the trigger blocking flange prevents actuation of the trigger to cause projectile discharge in an action assembly when a lever in the actuation assembly is in a partially cocked configuration.

In another aspect, a firearm is provided that comprises a disassembly latch pivoting about a latch pin at a front of an action assembly; where the disassembly latch includes a protrusion mating with a latching face in an action body in a latched configuration; where in an unlatched configuration, the protrusion is spaced away from the latching face; where the action assembly, in a loading configuration, is configured to guide a projectile into a barrel; and where the action assembly, in a discharge configuration, a striker is aligned to strike the projectile in the barrel.

In another aspect, a method for operation of a firearm is provided that comprises placing a lever in an action assembly in an extracted configuration; depressing a disassembly latch in the action assembly; rotating the action assembly about a trigger guard support pin in an action body; and removing the action assembly from the action body.

In yet another aspect, a breech loading firearm is provided that comprises a disassembly latch pivoting about a latch pin at a front of an action assembly; where the disassembly latch includes a protrusion mating with a latching face in an action body in a latched configuration; where in an unlatched configuration, the protrusion is spaced away from the latching face and is configured; where the action assembly, in a loading configuration, is configured to guide a projectile into a barrel; and where the action assembly, in a discharge configuration, a striker is aligned to strike the projectile in the barrel.

In any of the aspects or combinations of the aspects, the actuatable lever may include a first angled surface and the lever interface includes a second angled surface and where the first angled surface and the second angled surface are arranged at a similar/corresponding angle as measured from a horizontal axis.

In any of the aspects or combinations of the aspects, in the safe configuration, the first angled surface and the second angled surface may be in face sharing contact and where in a discharge configuration the first angled surface is spaced away from the second angled surface.

In any of the aspects or combinations of the aspects, the safety mechanism may be at least partially enclosed in a trigger guard.

In any of the aspects or combinations of the aspects, the firearm may be a breech loading firearm including a breech loading action assembly.

In any of the aspects or combinations of the aspects, the firearm may further comprise a spring loaded plunger coupled to the safety button and configured to laterally guide the safety button during actuation of the safety button.

In any of the aspects or combinations of the aspects, the trigger may include a trigger blocking flange positioned on a rear side of the trigger and where the trigger blocking flange prevents actuation of the trigger when a lever in an action assembly is in a partially cocked configuration.

In any of the aspects or combinations of the aspects, the lever may be configured to be placed in a fully cocked position where a sear is engaged with a tumbler and a loading configuration where the action assembly is configured for projectile loading.

In any of the aspects or combinations of the aspects, the sear may be designed to independently rotate with regard to the trigger.

In any of the aspects or combinations of the aspects, the partially cocked position may be any lever position between the loading position and the fully cocked position.

In any of the aspects or combinations of the aspects, when the lever is in the fully cocked position, actuation of the trigger may cause release of the tumbler to discharge a projectile loaded in a barrel of the firearm.

In any of the aspects or combinations of the aspects, the firearm may further comprise a spring coupled to a sear collar and the sear and configured to exert a return force on the sear when the sear is rotated away from a neutral configuration.

In any of the aspects or combinations of the aspects, the firearm may be a breech loading firearm and the action assembly is a breech loading action assembly.

In any of the aspects or combinations of the aspects, the firearm may further comprise a safety mechanism integrated into a trigger guard and positioned in front of the trigger.

In any of the aspects or combinations of the aspects, the actuatable lever may include a first angled surface and the lever interface includes a second angled surface and where the first angled surface and the second angled surface are arranged at a similar/corresponding angle as measured from a horizontal axis and where in the safe configuration, the first angled surface and the second angled surface are in face sharing contact and where in a discharge configuration the first angled surface is spaced away from the second angled surface.

In any of the aspects or combinations of the aspects, the sear may be designed to independently rotate with regard to the trigger.

In any of the aspects or combinations of the aspects, the fulcrum may be integrated into a trigger guard.

In any of the aspects or combinations of the aspects, in the unlatched configuration the action assembly may pivot about a trigger guard support pin.

In any of the aspects or combinations of the aspects, the trigger guard support pin may be press fit into the action body.

In any of the aspects or combinations of the aspects, the action assembly may be removed as a single piece in the unlatched configuration.

In any of the aspects or combinations of the aspects, the action assembly may include a striker sub-assembly with the striker having a removable striker stop pin extending through a body of the striker.

In any of the aspects or combinations of the aspects, where the striker sub-assembly may be at least partially enclosed in an opening in a block.

In any of the aspects or combinations of the aspects, the action assembly may include a removable block pivot pin coupled to a block and configured to allow for rotation of the block during projectile loading via the action assembly.

In any of the aspects or combinations of the aspects, the action assembly may include a spring loaded catch plunger configured to mate with a detent in a lever configured to place the firearm in a cocked configuration and a loading configuration.

In any of the aspects or combinations of the aspects, the spring loaded catch plunger may be at least partially positioned in a removable block support.

In any of the aspects or combinations of the aspects, the firearm may further comprise a forearm bracket connecting the action body to a forearm positioned below a barrel, where a compliant bushing at least partially surrounds the forearm bracket.

In any of the aspects or combinations of the aspects, the firearm may be a breech loading firearm and the action assembly may be configured for breach loading.

In any of the aspects or combinations of the aspects, the disassembly latch may be positioned at a front side of the action assembly.

In any of the aspects or combinations of the aspects, the trigger guard support pin may be positioned adjacent to a rear side of the action assembly prior to removal of the action assembly from the action body.

In any of the aspects or combinations of the aspects, in the unlatched configuration the action assembly may pivot about a trigger guard support pin and where the trigger guard support pin is press fit into the action body.

In any of the aspects or combinations of the aspects, the action assembly may include a striker sub-assembly with a striker having a removable striker stop pin extending through a body of the striker; and/or a removable block pivot pin coupled to a block and configured to allow for rotation of the block during projectile loading via the action assembly.

In any of the aspects or combinations of the aspects, the action assembly may be removed as a single piece in the unlatched configuration.

In any of the aspects or combinations of the aspects, the firearm may be a Martini-Henry style rifle.

In any of the aspects or combinations of the aspects, the action assembly may include a spring loaded catch plunger configured to mate with a detent in a lever configured to place the breech loading firearm in a cocked configuration and a loading configuration and where the spring loaded catch plunger is at least partially positioned in a removable block support.

As used herein, the terms "approximately" and "substantially" is construed to mean plus or minus five percent of the range unless otherwise specified.

It will be appreciated that the configurations and/or approaches described herein are exemplary in nature, and that these specific embodiments or examples are not to be considered in a limiting sense, because numerous variations are possible. For example, the above technology can be applied to various types of rifles and other firearms. The subject matter of the present disclosure includes all novel and nonobvious combinations and sub-combinations of the various features, functions, acts, and/or properties disclosed herein, as well as any and all equivalents thereof.

The invention claimed is:

1. A firearm comprising:

a disassembly latch pivoting about a latch pin at a front of an action assembly;

where the disassembly latch includes a protrusion mating with a latching face in an action body in a latched configuration;

where in an unlatched configuration, the protrusion is spaced away from the latching face;

where the action assembly, in a loading configuration, is configured to guide a projectile into a barrel;

where the action assembly, in a discharge configuration, a striker is aligned in the action assembly to strike the projectile in the barrel; and where the action assembly includes a removable block pivot pin coupled to a block and configured to allow for rotation of the block during projectile loading via the action assembly.

2. The firearm of claim 1, where in the latched configuration the action assembly is supported by a trigger guard support pin.

3. The firearm of claim 2, where the trigger guard support pin is press fit into the action body.

4. The firearm of claim 1, where the action assembly is removed as a single piece in the unlatched configuration.

5. The firearm of claim 1, where the action assembly includes a striker sub-assembly with the striker having a removable striker stop pin extending through a body of the striker.

6. The firearm of claim 1, where the firearm is a single shot rifle.

7. The firearm of claim 1, where the action assembly includes a spring loaded catch plunger configured to mate with a detent in a lever configured to place the firearm in a cocked configuration and the loading configuration.

8. The firearm of claim 7, where the action assembly includes a removable block support laterally positioned between two walls of a trigger guard.

9. A method for operation of a firearm comprising:

placing a lever in an action assembly in an extracted configuration;

depressing a disassembly latch in the action assembly, where the disassembly latch pivots about a latch pin at a front of the action assembly;

rotating the action assembly about a trigger guard support pin in an action body; and removing the action assembly from the action body;

where the disassembly latch includes a protrusion mating with a latching face in the action body in a latched configuration;

where in an unlatched configuration, the protrusion is spaced away from the latching face;

where the action assembly, in a loading configuration, is configured to guide a projectile into a barrel;

where the action assembly, in a discharge configuration, a striker is aligned in the action assembly to strike the projectile in the barrel; and where the action assembly includes a removable block pivot pin coupled to a block and configured to allow for rotation of the block during projectile loading via the action assembly.

10. The method of claim 9, where the firearm is a breech loading firearm and the action assembly is configured for breech loading.

11. The method of claim 9, where the disassembly latch is position at a front side of the action assembly.

12. The method of claim 9, where the trigger guard support pin is positioned adjacent to a rear side of the action assembly prior to removal of the action assembly from the action body.

13. A firearm comprising:

a disassembly latch pivoting about a latch pin at a front of an action assembly;

where the disassembly latch includes a protrusion mating with a latching face in an action body in a latched configuration;

where in an unlatched configuration, the protrusion is spaced away from the latching face and is configured;

where the action assembly, in a loading configuration, is configured to guide a projectile into a barrel;

where the action assembly, in a discharge configuration, a striker is aligned in the action assembly to strike the projectile in the barrel; and where the action assembly includes a spring loaded catch plunger configured to mate with a detent in a lever configured to place the breech loading firearm in a cocked configuration and the loading configuration and where the spring loaded catch plunger is at least partially positioned in a removable block support.

14. The firearm of claim 13, where in the latched configuration the action assembly is supported by a trigger guard support pin and where the trigger guard support pin is press fit into the action body.

15. The firearm of claim 13, where the action assembly includes:

a striker sub-assembly with the striker having a removable striker stop pin extending through a body of the striker; and/or a removable block pivot pin coupled to a block and configured to allow for rotation of the block during projectile loading via the action assembly.

16. The firearm of claim 13, where the action assembly is removed as a single piece in the unlatched configuration.

17. The firearm of claim 13, where the action assembly includes a removable block support laterally positioned between two walls of a trigger guard.

18. The firearm of claim 13, further comprising a gap positioned between a forearm and the action body, where the forearm is coupled to the barrel.

* * * * *